US010111532B2

(12) United States Patent
Small, Jr. et al.

(10) Patent No.: US 10,111,532 B2
(45) **Date of Patent: *Oct. 30, 2018**

(54) HEAT AND FLAME-RESISTANCE MATERIALS AND UPHOLSTERED ARTICLES INCORPORATING SAME

(71) Applicant: Precision Fabrics Group, Inc., Greensboro, NC (US)

(72) Inventors: James Douglas Small, Jr., Greensboro, NC (US); John H. Walton, Greensboro, NC (US); Samuel Mark Gillette, Burlington, NC (US); Ladson L. Fraser, Jr., High Point, NC (US); Zareh Mikaelian, High Point, NC (US)

(73) Assignee: Precision Fabrics Group, Inc., Greensboro, NC (US)

( * ) Notice: Subject to any disclaimer, the term of this patent is extended or adjusted under 35 U.S.C. 154(b) by 386 days.

This patent is subject to a terminal disclaimer.

(21) Appl. No.: 14/806,141

(22) Filed: Jul. 22, 2015

(65) Prior Publication Data

US 2015/0320231 A1 Nov. 12, 2015

Related U.S. Application Data

(60) Continuation of application No. 13/592,608, filed on Aug. 23, 2012, now abandoned, which is a (Continued)

(51) Int. Cl.
*A47C 31/00* (2006.01)
*A47C 27/045* (2006.01)
(Continued)

(52) U.S. Cl.
CPC ..... *A47C 27/0456* (2013.01); *A47C 31/001* (2013.01); *D06M 11/58* (2013.01);
(Continued)

(58) Field of Classification Search
CPC ..... A47C 31/001; D06M 11/80; D06M 11/68; D06M 11/58; D06M 2101/06
See application file for complete search history.

(56) References Cited

U.S. PATENT DOCUMENTS 2,610,338 A 9/1952 Taylor
3,889,022 A 6/1975 Whittaker et al.
(Continued)

FOREIGN PATENT DOCUMENTS

CA 2281416 A1 3/2000
CA 2446907 A1 11/2002
(Continued)

OTHER PUBLICATIONS

American Cyanamid Company, "Intumescent Coating Applications" (1990).

(Continued)

*Primary Examiner* — Jeremy R Pierce
(74) *Attorney, Agent, or Firm* — Myers Bigel, P.A.

(57) ABSTRACT

A mattress, foundation, or other upholstered sleep product or article includes a core and barrier material surrounding the core. The barrier material includes flame and heat-resistant material that is configured to prevent combustion of the core when the upholstered article is impinged with a gas flame according to California Technical Bulletin 603 of the State of California Department of Consumer Affairs. The barrier material may include an intumescent material that is configured to swell and char in the presence of a flame so as to form a barrier to the flame and to heat generated by the flame.

18 Claims, 3 Drawing Sheets

Related U.S. Application Data continuation of application No. 11/124,968, filed on May 9, 2005, now abandoned, which is a division of application No. 10/839,570, filed on May 5, 2004, now Pat. No. 7,150,059, application No. 14/806,141, which is a continuation-in-part of application No. 13/290,427, filed on Nov. 7, 2011, now Pat. No. 8,501,639, which is a continuation of application No. 12/172,681, filed on Jul. 14, 2008, now Pat. No. 8,796,162, which is a continuation of application No. 10/143,833, filed on May 14, 2002, now abandoned.

(60) Provisional application No. 60/467,979, filed on May 5, 2003, provisional application No. 60/290,352, filed on May 14, 2001.

(51) Int. Cl.

| | |
|---|---|
| ***D06M 11/80*** | (2006.01) |
| ***D06M 11/68*** | (2006.01) |
| ***D06M 11/58*** | (2006.01) |
| ***D06M 11/71*** | (2006.01) |
| ***D06M 11/72*** | (2006.01) |
| ***D06M 11/74*** | (2006.01) |
| ***D06M 13/292*** | (2006.01) |
| ***D06M 15/263*** | (2006.01) |
| ***D06M 15/433*** | (2006.01) |
| ***D06M 23/00*** | (2006.01) |
| ***D06M 23/04*** | (2006.01) |
| *D06M 101/06* | (2006.01) |

(52) U.S. Cl.

CPC ..... *D06M 11/68* (2013.01); *D06M 11/71* (2013.01); *D06M 11/72* (2013.01); *D06M 11/74* (2013.01); *D06M 11/80* (2013.01); *D06M 13/292* (2013.01); *D06M 15/263* (2013.01); *D06M 15/433* (2013.01); *D06M 23/00* (2013.01); *D06M 23/04* (2013.01); *D06M 2101/06* (2013.01); *D06M 2200/30* (2013.01); *Y10S 5/954* (2013.01); *Y10T 442/20* (2015.04); *Y10T 442/2631* (2015.04); *Y10T 442/2648* (2015.04); *Y10T 442/2656* (2015.04); *Y10T 442/2664* (2015.04); *Y10T 442/2672* (2015.04); *Y10T 442/2713* (2015.04); *Y10T 442/2721* (2015.04); *Y10T 442/3976* (2015.04); *Y10T 442/3984* (2015.04); *Y10T 442/647* (2015.04); *Y10T 442/696* (2015.04); *Y10T 442/697* (2015.04)

(56) References Cited

U.S. PATENT DOCUMENTS

| | | | | |
|---|---|---|---|---|
| 3,900,327 | A | 8/1975 | Miller | |
| 3,934,066 | A * | 1/1976 | Murch | E04B 1/94 442/221 |
| 3,985,170 | A | 10/1976 | Kay | |
| 4,041,203 | A | 8/1977 | Brock et al. | |
| 4,097,560 | A | 6/1978 | Littman et al. | |
| 4,148,602 | A | 4/1979 | LeBlanc et al. | |
| 4,211,622 | A | 7/1980 | Nablo | |
| 4,215,261 | A | 8/1980 | Dias | |
| 4,216,261 | A | 8/1980 | Dias | |
| 4,273,879 | A | 6/1981 | Langer et al. | |
| 4,374,888 | A | 2/1983 | Bornslaeger | |
| 4,442,164 | A | 4/1984 | Briggs et al. | |
| 4,448,841 | A | 5/1984 | Glass et al. | |
| 4,449,261 | A | 5/1984 | Magnusson | 5/465 |
| 4,504,991 | A | 3/1985 | Klancnik | 5/459 |
| 4,824,709 | A | 4/1989 | Tschirch | 428/95 |
| 4,866,799 | A | 9/1989 | Glackin | |
| 4,923,729 | A | 5/1990 | Porter et al. | |
| 4,955,095 | A | 9/1990 | Gerrick | 5/446 |
| 4,996,099 | A | 2/1991 | Cooke et al. | 442/4 |
| 5,024,851 | A | 6/1991 | Goad et al. | |
| 5,070,119 | A | 12/1991 | Nugent, Jr. et al. | |
| 5,091,243 | A | 2/1992 | Tolbert et al. | 442/60 |
| 5,175,197 | A | 12/1992 | Gestner et al. | |
| 5,279,878 | A * | 1/1994 | Fottinger | D04H 1/4242 112/402 |
| 5,384,188 | A | 1/1995 | Lebold et al. | |
| 5,433,991 | A | 7/1995 | Boyd, Jr. et al. | |
| 5,534,325 | A | 7/1996 | Jorder et al. | |
| 5,534,925 | A | 7/1996 | Jorder et al. | |
| 5,578,368 | A | 11/1996 | Forsten et al. | |
| 5,645,926 | A * | 7/1997 | Horrocks | A41D 31/0022 428/920 |
| 5,766,746 | A * | 6/1998 | Kampl | A41D 31/0027 28/104 |
| 5,811,359 | A | 9/1998 | Romanowskl | |
| 5,830,319 | A | 11/1998 | Landin | |
| 5,912,196 | A * | 6/1999 | Radwanski | C09K 21/04 442/139 |
| 5,974,609 | A | 11/1999 | Nunez et al. | |
| 6,098,224 | A | 8/2000 | Gladney | 5/716 |
| 6,132,476 | A | 10/2000 | Lunsford et al. | |
| 6,136,775 | A | 10/2000 | Strout et al. | |
| 6,153,668 | A | 11/2000 | Gestner et al. | |
| 6,153,674 | A | 11/2000 | Landin | |
| 6,207,085 | B1 | 3/2001 | Ackerman | |
| 6,265,082 | B1 | 7/2001 | Dunham et al. | |
| 6,309,746 | B1 | 10/2001 | Broutier et al. | |
| 6,420,470 | B1 | 7/2002 | Miksic et al. | |
| 6,436,528 | B1 | 8/2002 | Kulper et al. | |
| 6,574,815 | B2 | 7/2003 | Freeman et al. | |
| 6,721,982 | B2 | 4/2004 | Freeman | |
| 6,747,074 | B1 | 6/2004 | Buckingham et al. | |
| 6,804,849 | B2 | 10/2004 | Van Patten | |
| 6,823,548 | B2 | 11/2004 | Murphy et al. | |
| 8,440,582 | B2 * | 5/2013 | Jones | A47C 31/001 428/920 |
| 8,501,639 | B2 * | 8/2013 | Monfalcone, III | D06M 11/47 428/920 |
| 8,513,145 | B2 * | 8/2013 | Jones | A47C 31/001 428/920 |
| 8,796,162 | B2 * | 8/2014 | Monfalcone, III | D06M 11/47 428/920 |
| 9,006,118 | B2 * | 4/2015 | Jones | A47C 31/001 428/920 |
| 2003/0082972 | A1 | 5/2003 | Monfalcone, III et al. | |
| 2004/0062912 | A1 | 4/2004 | Mason et al. | |
| 2004/0106347 | A1 | 6/2004 | McGuire et al. | |
| 2004/0158928 | A1 | 8/2004 | Gladney | |
| 2005/0055776 | A1 | 3/2005 | Cavazos | |
| 2005/0227558 | A1 | 10/2005 | Small, Jr. et al. | |
| 2005/0287894 | A1 | 12/2005 | Burns et al. | |

FOREIGN PATENT DOCUMENTS

| | | |
|---|---|---|
| EP | 0 391 000 A2 | 10/1990 |
| GB | 1523152 | 12/1978 |
| GB | 2293572 | 4/1996 |
| GB | 2336163 A | 10/1999 |
| GB | 2352447 A | 1/2001 |
| JP | 08-226057 | 9/1996 |
| JP | H8-226057 | 9/1996 |
| WO | WO 1993/018824 A1 | 9/1993 |
| WO | WO 02/092901 A2 | 11/2002 |
| WO | 2004031464 | 4/2004 |
| WO | WO 04/031464 | 4/2004 |

OTHER PUBLICATIONS

E I du Pont de Nemours & Co., Inc., Res. Disclosure 138:9 (1975).
Kandola & horrocks, Textile Res. J. 69(5):374-381 (1999).
Horrocks, Polymer Degradation Stability 54:143-154 (1996).
Horrocks & Kandola, J. Coated Fabrics 27:17-26 (1997).
Horrocks et al., Indian J. Fibre Textile Res. 22:264-273 (1997).

(56) References Cited

OTHER PUBLICATIONS

Horrocks et al., Nonwovens World 9:75-82 (2000).
Horrocks, et al., Polymer Intl. 49:1079-1091 (2000).
"Fiber Science" pp. 273-275, 1995.
Adanur Sabit, Wellington Sears Handbook of Industrial Textiles, 1995, p. 153.
California Technical Bulletin 117, "Suggested Bench-Scale Furniture Test Hood Specifications", May 2002.
Canadian Office Action Corresponding to Canadian Application No. 2,524,803; dated Jan. 18, 2012; 4 pages.
Complete Textile Glossary—definition of "nonwoven", 2001.
International Search Report and the Written Opinion of the International Searching Authority, corresponding to International Application No. PCT/US2004/014053, dated Oct. 25, 2006.
National Fire Protection Association, An American National Standard/NFPA 701, "Fire Tests for Flame-Resistant Textiles and Films", 1989.
Office Action dated Apr. 5, 2011 by the Canadian Patent Office for corresponding Canadian Patent Application No. 2,524,803.
Office Action dated Jul. 14, 2008 by the Canadian Patent Office for corresponding Canadian Patent Application No. 2,524,803.
State of California, Department of Consumer Affairs Bureau of Home Furnishings and Thermal Insulation, Technical Bulletin 603, Jul. 2003.
State of California, Department of Consumer Affairs, Bureau of Home Furnishings and Thermal Insulation, Technical Bulletin 133, "Flammability Test Procedure for Seating Furniture for Use in Public Occupancies", Jan. 1991.
State of California, Department of Consumer Affairs, Bureau of Home Furnishings and Thermal Insulation, Technical Bulletin 129, "Flammability Test Procedure for Seating Furniture for Mattresses for Use in Public Buildings", Oct. 1992.
State of California, Department of Consumer Affairs, Bureau of Home Furnishings and Thermal Insulation, Technical Bulletin 603, "Requirements and Test Procedure for Resistance of a Residential Mattress/Box Spring Set to a Large Open-Flame", Feb. 2003.
Vander Beke, Bob, "Halogen Free Flame Retardant Coatings on Textiles—An Overview", Centexbel, Apr. 25, 2002.
Vander Bake, Bob, "Halogen Free Flame Retardant Coatings on Textiles—An Overview", Centexbel, Apr. 25, 2002.
U.S. Appl. No. 13/592,608; Office Action dated Jan. 23, 2015.
U.S. Appl. No. 13/690,294; Office Action dated Jan. 23, 2015.
Petition for Inter Partes Review Under 35 U.S.C. §§ 311-319 and 37 C.F.R. § 42.100 ET. SEQ. (66 pages) (Filing date: Aug. 4, 2014).
Petitioner's Power of Attorney Pursuant to 37 CFR 42.10(b) for Petition for Inter Partes Review in the Inter Partes Review of U.S. Pat. No. 8,501,639 (1 page) (Filing date: Aug. 4, 2014).
Declaration of Charles A. Wilkie in Support of Petition for Inter Partes Review Under 35 U.S.C. § 42.100 et seq. (Claims 1-22 of U.S. Pat. No. 8,501,639) dated Jun. 18, 2014 (145 pages) (Filing date: Aug. 4, 2014).
Declaration of A. Frank Baldwin, Jr. Pursuant to 37 C.F.R. § 1.132 dated Dec. 19, 2012 (18 pages) (Filing date: Aug. 4, 2014).
Declaration of A. Frank Baldwin, Jr. Pursuant to 37 C.F.R. § 1.132 dated Jan. 23, 2013 (7 pages) (Filing date: Aug. 4, 2014).
Declaration of A. Frank Baldwin, Jr. Pursuant to 37 C.F.R. § 1.132 dated Feb. 22, 2013 (7 pages) (Filing date: Aug. 4, 2014).
United States Patent and Trademark Office Communication of an Applicant-Initiated Interview Summary corresponding to U.S. Appl. No. 13/290,427 dated Dec. 7, 2012 (4 pages) (filed Aug. 4, 2014).
United States Patent and Trademark Office Communication of a Notice of Allowability corresponding to U.S. Appl. No. 13/290,427 dated Mar. 28, 2013 (4 pages) (filed Aug. 4, 2014).
United States Patent and Trademark Office Communication of a Decision on Appeal corresponding to U.S. Appl. No. 12/172,681 dated Sep. 7, 2011 (6 pages) (filed Aug. 4, 2014).
Notice of Filing Date Accorded to Petition and Time for Filing Patent Owner Preliminary Response corresponding to Case IPR2014-01248; U.S. Pat. No. 8,501,639 (3 pages) (dated Aug. 15, 2014).
Corrected Petition for Inter Partes Review Under 35 U.S.C. §§ 311-319 and 37 C.F.R. § 42.100 et. seq. corresponding to U.S. Pat. No. 8,501,639 (68 pages) (Filing date: Aug. 18, 2014).
Patent Owner Precision Fabrics Group, Inc.'s Power of Attorney corresponding to Case IPR2014-01248; U.S. Pat. No. 8,501,639 (2 pages) (Filing date: Aug. 25, 2014).
Patent Owner Precision Fabrics Group, Inc.'s Mandatory Notices Under 37 C.F.R. § 42.8 corresponding to Case IPR2014-01248; U.S. Pat. No. 8,501,639 (4 pages) (Filing date: Aug. 25, 2014).
Notice of Accepting Corrected Petition corresponding to Case IPR2014-01248; U.S. Pat. No. 8,501,639 (2 pages) (Mailed: Sep. 5, 2014).
Patent Owner Preliminary Response Pursuant to 37 C.F.R. § 42.107(a) corresponding to Case IPR2014-01248; U.S. Pat. No. 8,501,639 (69 pages) (Filing date: Nov. 14, 2014).
Adanur, Sabit, B.S., M.S., Ph.D., *Wellington Sears Handbook of Industrial Textiles* pp. 153, 538-540 (1995) (Filing date: Nov. 14, 2014).
U.S. Pat. No. 8,501,639 Prosecution History Part 2 (500 pages) (Filing date: Nov. 14, 2014).
U.S. Pat. No. 8,501,639 Prosecution History Part 1 (495 pages) (Filing date: Nov. 14, 2014).
Deposition of Charles A. Wilkie (Taken by Plaintiff) Aug. 20, 2014 Excerpts corresponding To United States District Court Civil Action No. 1:13-CBV-00645 (13 pages) (Filing date: Nov. 14, 2014).
Decision Institution of Inter Partes Review 37 C.F.R. § 42.108 corresponding to Case IPR2014-01248; U.S. Pat. No. 8,501,639 (14 pages) (Entered: Jan. 30, 2015).
Scheduling Order corresponding to Case IPR2014-01248; U.S. Pat. No. 8,501,639 (7 pages) (Entered: Jan. 30, 2015).
Order Conduct of the Proceeding 37 C.F.R. § 42.5 corresponding to Case IPR2014-01248; U.S. Pat. No. 8,501,639 (4 pages) (Entered: Mar. 4, 2015).
Order Conduct of the Proceeding 37 C.F.R. § 42.5 corresponding to Case IPR2014-01248; U.S. Pat. No. 8,501,639 (4 pages) (Entered: Apr. 22, 2015).
Patent Owner Response Pursuant to 37 C.F.R. § 42.120 corresponding to Case IPR2014-01248; U.S. Pat. No. 8,501,639 (71 pages) (Filing date: Apr. 29, 2015).
Declaration of Gajanan S. Bhat, Ph.D. corresponding to Case IPR2014-01248; U.S. Pat. No. 8,501,639 (136 pages) (Filing date: Apr. 29, 2010).
Bourbigot et al. "Intumescence-Based Fire Retardants" *Fire Retardancy of Polymeric Materials* Second Edition, Chapter 6:pp. 129-162 (2010) (Filing date: Apr. 29, 2015).
Memorandum Opinion and Order corresponding to United States District Court Case Nos. 1:13cv645 & 1:14cv650 dated Jan. 15, 2015 (21 pages) (Filing date: Apr. 29, 2015).
National Fire Protection Association (NFPA) 1971 Standard on Protective Ensemble for Structural Fire Fighting (5 pages) (Filing date: Apr. 29, 2015).
Precision-011462 Video (1 minute, 1 seconds) can be accessed via the U.S. Patent & Trademark Office Patent Trial and Appeal Board Website (Filing date: Apr. 29, 2015).
Precision-011462 Video (1 minute, 3 seconds) can be accessed via the U.S. Patent & Trademark Office Patent Trial and Appeal Board Website (Filing date: Apr. 29, 2015).
Lichstein et al. "The Nonwovens Handbook" Excerpts (55 pages) (1988) (Filing date: Apr. 29, 2015).
Webster's Third New International Dictionary: Definition of "Intumescent" (2 pages) (Filing date: Apr. 29, 2015).
Rosato et al. "Recent Advances in Flame Retardancy of Polymeric Foams" *Plastics Technology Handbook* vol. 1(16.4):9 pages (2010) (Filing date: Apr. 29, 2015).
Declaration of A. Frank Baldwin, Jr. corresponding to Case IPR2014-01248; U.S. Pat. No. 8,501,639 (5 pages) (Filing date: Apr. 29, 2015).
Declaration of Tom Taylor corresponding to Case IPR2014-01248; U.S. Pat. No. 8,501,639 (8 pages) (Filing date: Apr. 29, 2015).
Damant, Gordon "Flammability . . . the issue heats up" *BEDtimes* 60:9 pages (2000) (Filing date: Apr. 29, 2015).

(56) References Cited

OTHER PUBLICATIONS

Perry, David "Serta remains No. 1; Simmons is fastest growing" Furnituretoday.com (3 pages) (Jun. 16, 2014) (Filing date: Apr. 29, 2015).
Declaration of Allen N. Podratsky corresponding to Case IPR2014-01248; U.S. Pat. No. 8,501,639 (9 pages) (Filing date: Apr. 29, 2015).
"CPSC Approves New Flammability Standard for Mattresses, Federal standard could prevent 270 deaths each year" *United States Consumer Product Safety Commission(CPSC)* (6 pages) (Feb. 16, 2006) (Filing date: Apr. 29, 2015).
Global Supply Chain Partners, Inc. (GSCP) Report/Memo on "Doe Filler Cloth Substitution" Presented May 24, 2007 (4 pages) (Filing date: Apr. 29, 2015).
Global Supply Chain Partners, Inc. (GSCP) Report/Memo on "Tietex as a Replacement for PFG in Prototypes using Western Nonwoven TB60 .9 oz High Loft FR Barrier" (5 pages) (Sep. 24, 2007) (Filing date: Apr. 29, 2015).
Plaintiff's Disclosure of Asserted Claims and Preliminary Infringement Contentions corresponding to United States District Court Case No. 1:13-CV-00645 (25 pages) (dated Jan. 29, 2014) (Filing date: Apr. 29, 2015).
Defendant's Disclosure of Preliminary Non-Infringement Contentions corresponding to United States District Court Case No. 1:13-CV-00645 (14 pages) (dated Mar. 17, 2014) (Filing date: Apr. 29, 2015).
Email Chain between Counsel for Patent Owner and Counsel for Petitioner dated Aug. 21, 2014 (7 pages) (Filing date: Apr. 29, 2015).
Excerpts from the Deposition of Charles A. Wilkie (41 pages) (Filing date: Apr. 29, 2015).
Petitioner's Notice of Deposition of Gajanan S. Bhat, Ph.D. corresponding to Case IPR2014-01248; U.S. Pat. No. 8,501,639 (4 pages) (Filing date: May 22, 2015).
Petitioner's Notice of Deposition of Allen N. Podratsky corresponding to Case IPR2014-01248: U.S. Pat. No. 8,501,639 (4 pages) (Filing date: May 22, 2015).
Petitioner's Amended Notice of Deposition of Allen N. Podratsky corresponding to Case IPR2014-01248; U.S. Pat. No. 8,501,639 (4 pages) (Filing date: Jun. 17, 2015).
Petitioner's Second Amended Notice of Deposition of Allen N. Podratsky corresponding to Case IPR2014-01248; U.S. Pat. No. 8,501,639 (4 pages) (Filing date: Jun. 22, 2015).
Petitioner's Notice of Deposition of Tom Taylor corresponding to Case IPR2014-01248; U.S. Pat. No. 8,501,639 (4 pages) (Filing date: Jun. 29, 2015).
Petitioner's Notice of Deposition of Gajanan S. Bhat, Ph.D. corresponding to Case IPR2014-01248; U.S. Pat. No. 8,501,639 (4 pages) (Filing date: Jul. 28, 2015).
Bhat, Gajanan S. "Flame resistant nonwoven fabrics" *Handbook of fire resistant textiles* (27 pages) (2013) (Filing date: Jul. 28, 2015).
Petitioner's Notice of Deposition of Allen N. Podratsky corresponding to Case IPR2014-01248; U.S. Pat. No. 8,501,639 (4 pages) (Filing date: Jul. 28, 2015).
Perry, David "Bedding innovations abound" Furnituretoday.com(3 pages) (Mar. 13, 2006) (Filing date: Jul. 28, 2015).
"Ticking Trends" *BedTimes* (4 pages) (Oct. 2005) (Filing date: Jul. 28, 2015).
Global Supply Chain Partners, Inc. Website Printout (2 pages) (2006-2015) (Filing date: Jul. 28, 2015).
"New Products" *BedTimes* (5 pages) (Oct. 2006) (Filing date: Jul. 28, 2015).
Whitcomb, Dorothy "Pratrivero celebrates 350 years in textiles" *BedTimes* (3 pages) (Jun. 2013) (Filing date: Jul. 28, 2015).
Petitioner Reply corresponding to Case IPR2014-01248; U.S. Pat. No. 8,501,639 (22 pages) (Filing date: Jul. 29, 2015).
Declaration of Dr. A. Richard Horrocks corresponding to Case IPR2014-01248; U.S. Pat. No. 8,501,639 (58 pages) (dated Jul. 28, 2015) (Filing date: Jul. 29, 2015).
Kimberly-Clark Scott 11659 Hydroknit Fabric All-Purpose Disposable Drop Cloth Printout from Amazon.com 1 page (Filing date: Jul. 29, 2015).
Patent Owner's Notice of Deposition of Dr. A. Richard Horrocks corresponding to Case IPR2014-01248; U.S. Pat. No. 8,501,639 (3 pages) (Filing date: Aug. 24, 2015).
Patent Owner's Exhibit List corresponding to Case IPR2014-01248; U.S. Pat. No. 8,501,639 (5 pages) (Filing date: Sep. 21, 2015).
Declaration of Dr. A. Richard Horrocks corresponding to Case IPR2014-01248; U.S. Pat. No. 8,501,639 (59 pages) (dated Jul. 28, 2015) (Filing date: Sep. 21, 2015).
Horrocks, A. Richard "Flame retardant/resistant textile coatings and laminates" *Advances in fire retardant materials* (16 pages) (2008) (Filing date: Sep. 21, 2015).
Sample of Patent Owner's Stitchbounded Fabric "FR Filler Cloth: Style 881" (2 pages) (Filing date: Sep. 21, 2015).
Horrocks, A. Richard "Developments in flame-retarding polyester/cotton blends" *JSDC* 105:346-349 (1989) (Filing date: Sep. 21, 2015).
Deposition Transcript of Arthur Richard Horrocks, Ph.D. corresponding to Case IPR2014-01248; U.S. Pat. No. 8,501,639 (142 pages) (dated Sep. 2, 2015) (Filing date: Sep. 21, 2015).
Patent Owner Precision Fabrics Group, Inc.'s Objection to the Declaration of Charles A. Wilkie Pursuant to 37 C.F.R. § 42.64(b)(1) corresponding to Case IPR2014-01248; U.S. Pat. No. 8,501,639 (8 pages) (dated Feb. 13, 2015) (Filing date: Sep. 21, 2015).
Patent Owner Precision Fabrics Group, Inc.'s Objection to the Declaration of Dr. A. Richard Horrocks (Exhibit 1022) Pursuant to 37 C.F.R. § 42.64(b)(1) corresponding to Case IPR2014-01248; U.S. Pat. No. 8,501,639 (4 pages) (dated Aug. 5, 2015) (Filing date: Sep. 21, 2015).
Patent Owner Precision Fabrics Group, Inc.'s Objection to Exhibit 1023 Pursuant to 37 C.F.R. § 42.64(b)(1) corresponding to Case IPR2014-01248; U.S. Pat. No. 8,501,639 (4 pages) (dated Aug. 5, 2015) (Filing date: Sep. 21, 2015).
Patent Owner's Motion for Observation Regarding Cross-Examination of Petitioner's Reply Witness, Dr. A. Richard Horrocks corresponding to Case IPR2014-01248; U.S. Pat. No. 8,501,639 (11 pages) (Filing date: Sep. 21, 2015).
Patent Owner's Motion to Exclude the Declaration of Charles A. Wilkie (Exhibit 1002), the Declaration of Dr. A. Richard Horrocks (Exhibit 1022), and Exhibit 1023 Under 37 C.F.R. §§ 42.62 and 42.64(c) corresponding to Case IPR2014-01248; U.S. Pat. No. 8,501,639 (18 pages) (Filing date: Sep. 21, 2015).
Patent Owner's Request for Oral Argument corresponding to Case IPR2014-01248; U.S. Pat. No. 8,501,639 (4 pages) (Filing date: Sep. 21, 2015).
Order Request for Oral Argument 37 C.F.R. § 42.70 corresponding to Case IPR2014-01248; U.S. Pat. No. 8,501,639 (4 pages) (Entered: Sep. 30, 2015).
Petitioner's Opposition to Motion to Exclude the Declaration of Charles A. Wilkie (Exhibit 1002), the Declaration of Dr. A. Richard Horrocks (Exhibit 1022), and Exhibit 1023 Under 37 C.F.R. §§ 42.62 and 42.64(c) corresponding to Case IPR2014-01248; U.S. Pat. No. 8,501,639 (18 pages) (Filing date: Oct. 5, 2015).
Petitioner's Response to Patent Owner's Observations Regarding Cross-Examination of Petitioner's Reply Witness, Dr. A. Richard Horrocks corresponding to Case IPR2014-01248; U.S. Pat. No. 8,501,639 (8 pages) (Filing date: Oct. 5, 2015).
Petitioner's Exhibit List corresponding to Case IPR2014-01248; U.S. Pat. No. 8,501,639 (5 pages) (Filing date: Oct. 5, 2015).
Transcript of Deposition of Gajanan S. Bhat, Ph.D. corresponding to Case IPR2014-01248; U.S. Pat. No. 8,501,639 (292 pages) (dated Jun. 10, 2015) (Filing date: Oct. 5, 2015).
Transcript of Deposition of Allen Podratsky corresponding to Case IPR2014-01248; U.S. Pat. No. 8,501,639 (297 pages) (dated Jun. 26, 2015) (Filing date: Oct. 5, 2015).
Transcript of Deposition of Thomas E. Taylor corresponding to Case IPR2014-01248; U.S. Pat. No. 8,501,639 (205 pages) (dated Jul. 14, 2015) (Filing date: Oct. 5, 2015).
Borchers, Lynne email to the U.S. Patent & Trademark Office Patent Trial & Appeal Board dated Aug. 13, 2015 (1 page) (Filing date: Oct. 7, 2015).

(56) References Cited

OTHER PUBLICATIONS

U.S. Patent & Trademark Office Patent Trial & Appeal Board email to Lynne Borchers dated Aug. 18, 2015 (2 pages) (Filing date: Oct. 7, 2015).
Petitioner's Exhibit List corresponding to Case IPR2014-01248; U.S. Pat. No. 8,501,639 (5 pages) (Filing date: Oct. 7, 2015).
Petitioner's Corrected Oppositio to Motion to Exclude the Declaration of Charles A. Wilkie (Exhibit 1002), the Declaration of Dr. A. Richard Horrocks (Exhibit 1022), and Exhibit 1023 Under 37 C.F.R. §§ 42.62 and 42.649c) corresponding to Case IPR204-01248; U.S. Pat. No. 8,501,639 (18 pages) (Filing date: Oct. 7, 2015).
Full Transcript of Deposition of Charles A. Wilkie (Taken by Plaintiff) on Aug. 20, 2014 corresponding to District Court Case No. 1:13-CV-00645 (415 pages) (Filing date: Oct. 13, 2015).
Patent Owner's Exhibit List corresponding to Case IPR2014-01248; U.S. Pat. No. 8,501,639 (5 pages) (Filing date: Oct. 13, 2015).
Patent Owner's Reply in Support of Its Motion to Exclude the Declaration of Charles A. Wilkie (Exhibit 1002), the Declaration of Dr. A. Richard Horrocks (Exhibit 1022), and Exhibit 1023 Under 37 C.F.R. §§ 42.62 and 42.64(c) corresponding to Case IPR2014-01248; U.S. Pat. No. 8,501,639 (8 pages) (Filing date: Oct. 13, 2015).
Petitioner's Oral Hearing Demonstrative Exhibits corresponding to Case IPR2014-01248; U.S. Pat. No. 8,501,639 (24 pages) (Filing date: Oct. 21, 2015).
Patent Owner's Oral Argument Demonstrative Exhibits corresponding to Case IPR2014-01248; U.S. Pat. No. 8,501,639 (70 pages) (Filing date: Oct. 22, 2015).
Patent Owner's Submission of Demonstrative Exhibits for Oral Argument corresponding to Case IPR2014-01248; U.S. Pat. No. 8,501,639 (3 pages) (Filing date: Oct. 22, 2015).
Patent Owner's Exhibit List corresponding to Case IPR2014-01248; U.S. Pat. No. 8,501,639 (5 pages) (Filing date: Oct. 22, 2015).
Petitioner's Revised Demonstrative Exhibits corresponding to Case IPR2014-01248; U.S. Pat. No. 8,501,639 (24 pages) (Filing date: Oct. 25, 2015).
Petitioner's Exhibit List corresponding to Case IPR2014-01248; U.S. Pat. No. 8,501,639 (5 pages) (Filing date: Oct. 25, 2015).
United States Patent & Trademark Office Patent Trial and Appeal Board Record of Oral Hearing Held Oct. 26, 2015 corresponding to Case IPR2014-01248; U.S. Pat. No. 8,501,639 (42 pages) (Entered Nov. 17, 2015).
Transcript of Teleconference Proceedings corresponding to Case IPR2014-01248; U.S. Pat. No. 8,501,639 (17 pages) (Entered Nov. 18, 2015).
Final Written Decision 35 U.S.C. § 318(a) and 37 C.F.R. § 42.73 corresponding to Case IPR2014-01248; U.S. Pat. No. 8,501,639 (23 pages) (Entered: Jan. 27, 2016).
Petitioner Tietex International, Ltd.'s Notice of Appeal corresponding to Case IPR2014-01248; U.S. Pat. No. 8,501,639 (30 pages) (Dated Feb. 10, 2016).
Notice of Entry of Judgment Without Opinion corresponding to Case IPR2014-01248; U.S. Pat. No. 8,501,639 (5 pages) (Entered Mar. 10, 2017).
Order on Petition for Panel Rehearing and Rehearing en banc corresponding to Case IPR2014-01248; U.S. Pat. No. 8,501,639 (2 pages) (Dated May 11, 2017).
Petition for Inter Partes Review Under 35 U.S.C. §§ 311-319 and 37 C.F.R § 42.100 ET. SEQ. (68 pages) (Filing date: Aug. 4, 2015).
Petitioner Tietex International, Ltd.'s Power of Attorney Pursuant to 37 CFR 42.10(b) for Petition for Inter Partes Review of U.S. Pat. No. 8,796,162 (2 pages) (Filing date: Aug. 4, 2015).
Declaration of Brian Callaway in Support of Petition for Inter Partes Review Under 35 U.S.C. § 311 ET. SEQ. and 37 C.F.R. § 42.100 ET SEQ. (Claims 1-30 of U.S. Pat. No. 8,796,162) (77 pages) (Filing date: Aug. 4, 2015).
Declaration of Dr. A. Richard Horrocks dated Jul. 30, 2015 (91 pages) (Filing date: Aug. 4, 2015).
United States Patent and Trademark Office Communication of a Decision on Appeal corresponding to U.S. Appl. No. 12/172,681 dated Sep. 7, 2011 (6 pages) (filed Aug. 4, 2015).
Notice of Filing Date Accorded to Petition and Time for Filing Patent Owner Preliminary Response corresponding to Case IPR2015-01671; U.S. Pat. No. 8,796,162 (3 pages) (Mailed: Aug. 4, 20150.
Patent Owner Precision Fabrics Group, Inc.'s Mandatory Notices Under 37 C.F.R. § 42.8 corresponding to Case IPR2015-01671; U.S. Pat. No. 8,796,162 (4 pages) (Filing date: Aug. 25, 2015).
U.S. Pat. No. 8,501,639 Prosecution History Part 2 (500 pages) (Filing date: Nov. 12, 2015).
U.S. Pat. No. 8,501,639 Prosecution History Part 1 (495 pages) (Filing date: Nov. 12, 2015).
U.S. Pat. No. 8,796,162 Prosecution History Part 2 (176 pages) (Filing date: Nov. 12, 2015).
U.S. Pat. No. 8,796,162 Prosecution History Part 1 (171 pages) (Filing date: Nov. 12, 2015).
Declaration of Gajanan S. Bhat, Ph.D. corresponding to Case IPR2014-01248; U.S. Pat. No. 8,501,639 dated Apr. 28, 2015 (136 pages) (Filing date: Nov. 12, 2015).
Declaration of Tom Taylor corresponding to Case IPR2014-01248; U.S. Pat. No. 8,501,639 dated Apr. 29, 2015 (8 pages) (Filing date: Nov. 12, 2015).
Defendant's Disclosure of Preliminary Non-Infringement Contentions corresponding to United States District Court Civil Action Nos. 1:13-cv-00645, 1:14-CV-650 dated Mar. 2, 2015 (7 pages) (Filing date: Nov. 12, 2015).
Declaration of Allen N. Podratsky corresponding to Case IPR2014-01248; U.S. Pat. No. 8,501,639 dated Apr. 29, 2015 (9 pages) (Filing date: Nov. 12, 2015).
Damant, Gordon "Flammability . . . the issue heats up" *BEDtimes* 60:9 pages (2000) (Filing date: Nov. 12, 2015).
Patent Owner Preliminary Response Pursuant to 37 C.F.R. § 42.107(a) corresponding to Case IPR2015-01674; U.S. Pat. No. 8,796,162 (72 pages) (Filing date: Nov. 12, 2015).
Order Conduct of the Proceeding 37 C.F.R. § 42.5(c)(3) corresponding to Case IPR2015-01671; U.S. Pat. No. 8,796,162 (6 pages) (Entered: Nov. 19, 2015).
Decision Denying Institution of Inter Partes Review 37 C.F.R. § 42.108 corresponding to Case IPR2015-01671; U.S. Pat. No. 8,796,162 (16 pages) (Entered: Feb. 11, 2016).
Petitioner Tietex International, Ltd.'s Request for Rehearing Under 37 CFR 42.71(c) of Decision Denying Institution of Inter Partes Review corresponding to Case IPR2015-01671; U.S. Pat. No. 8,796,162 (16 pages) (Filing date: Mar. 11, 2016).
Complaint (Jury Trial Demanded) corresponding to United States District Court Civil Action No. 1:13-cv-645 (3 pages) (dated Aug. 6, 2013).
Answer to Complaint and Counterclaims (Jury Trial Requested) corresponding to United States District Court Civil Action No. 1:13-cv-645 (13 pages) (dated Aug. 12, 2013).
Answer to Counterclaims corresponding to United States District Court Civil Action No. 1:13-cv-645 (4 pages) (dated Sep. 20, 2013).
Defendant's Motion to Amend Its Answer and Counterclaims and Exhibit 1 corresponding to United States District Court Civil Action No. 1:13-cv-645 (21 pages) (dated Feb. 28, 2014).
First Amended Answer to Complaint and Counterclaims (Jury Trial Requested) corresponding to United States District Court Civil Action No. 1:13-cv-645 (15 pages) (dated Mar. 11, 2014).
Defendant's Second Motion to Amend Its Answer and Counterclaims corresponding to United States District Court Civil Action No. 1:13-cv-645 (21 pages) (dated Mar. 12, 2014).
Second Amended Answer to Complaint and Counterclaims (Jury Trial Requested) corresponding to United States District Court Civil Action No. 1:13-cv-645 (15 pagse) (dated Mar. 12, 2014).
Answer to Second Amended Counterclaims corresponding to United States District Court Civil Action No. 1:13-cv-645 (6 pages) (dated Apr. 21, 2014).
Joint Claim Construction Statement and Attachments 1-3 corresponding to United States District Court Civil Action No. 1:13-cv-645 (80 pages) (dated Jul. 14, 2014).

(56) References Cited

OTHER PUBLICATIONS

Motion for Leave to File a Supplemental and Amended Complaint and for Consolidation and Attachments 1-2 corresponding to United States District Court Civil Action No. 1:13-cv-645 (13 pages) (dated Aug. 5, 2014).
Plaintiff's Brief in Support of Its Motion for Leave to File a Supplemental and Amended Complaint and for Consolidation corresponding to United States District Court Civil Action No. 1:13-cv-645 (16 pages) (dated Aug. 5, 2014).
Complaint (Jury Trial Demanded) corresponding to United States District Court Civil Action No. 1:14-cv-650 (8 pages) (dated Aug. 5, 2014).
Supplemental and Amended Complaint (Jury Trial Demanded) corresponding to United States District Court Civil Action No. 1:13-cv-645 (8 pages) (dated Sep. 8, 2014).
Answer to Supplemental and Amended Complaint and Counterclaims (Jury Trial Requested) corresponding to United States District Court Civil Action No. 1:13-cv-645 (24 pages) (dated Sep. 22, 2014).
Answer to Complaint and Counterclaims (Jury Trial Requested) corresponding to United States District Court Civil Action No. 1:14-cv-00650 (24 pages) (dated Sep. 22, 2014).
Amended Complaint (Jury Trial Demanded) and Exhibit A corresponding to United States District Court Civil Action No. 1:14-cv-650 (18 pages) (dated Oct. 16, 2014).
Answer to Counterclaims corresponding to United States District Court Civil Action No. 1:13-cv-00645 (10 pages) (dated Oct. 16, 2014).
Answer to Counterclaims corresponding to United States District Court Civil Action No. 1:14-cv-00650 (10 pages) (dated Oct. 16, 2014).
Answer to Amended Complaint and Counterclaims (Jury Trial Requested) corresponding to United States District Court Civil Action No. 1:13-cv-00645 (25 pages) (dated Oct. 30, 2014).
Answer to Amended Complaint and Counterclaims (Jury Trial Requested) corresponding to United States District Court Civil Action No. 1:14-cv-00650 (25 pages) (dated Oct. 30, 2014).
Plaintiff Precision Fabric Group Inc.'s Opening Claim Construction Brief corresponding to United States District Court Civil Action No. 1:13-cv-00645 (26 pages) (dated Nov. 17, 2014).
Declaration of Lynne A. Borchers in Support of Plaintiff Precision Fabric Group Inc.'s Opening Claim Construction Brief (Exhibits A-G not included) corresponding to United States District Court Civil Action No. 1:13-cv-00645 (3 pages) (dated Nov. 17, 2014).
Plaintiff Precision Fabric Group's Motion to Strike the Declaration and Preclude Testimony of Dr. Wilkie with 1 Attachment corresponding to United States District Court Civil Action No. 1:13-cv-645 (4 pages) (dated Nov. 17, 2014).
Plaintiff Precision Fabric Group Inc.'s Brief in Support of its Motion to Strike the Declaration and Preclude Testimony of Dr. Wilkie corresponding to United States District Court Civil Action No. 1:13-cv-645 (17 pages) (dated Nov. 17, 2014).
Declaration of Lynne A. Borchers in Support of Plaintiff Precision Fabric Group Inc.'s Motion to Strike the Declaration and Preclude Testimony of Dr. Wilkie and Exhibits 1-3 corresponding to United States District Court Civil Action No. 1:13-cv-645 (59 pages) (dated Nov. 17, 2014).
Defendant's Opening Brief on Claim Construction (Exhibits A-V: not included) corresponding to United States District Court Civil Action No. 1:13-cv-645 (31 pages) (dated Nov. 17, 2014).
Answer to Counterclaims corresponding to United States District Court Civil Action No. 1:14-cv-00650 (10 pages) (dated Nov. 24, 2014).
Plaintiff Precision Fabric Group Inc.'s Responsive Claim Construction Brief corresponding to United States District Court Civil Action No. 1:13-cv-645 (26 pages) (dated Dec. 1, 2014).
Declaration of Lynne A. Borchers in Support of Plaintiff Precision Fabric Group Inc.'s Responsive Claim Construction Brief with Exhibits H-I corresponding to United States District Court Civil Action No. 1:13-cv-645 (14 pages) (dated Dec. 1, 2014).
Notice of Manual Filing corresponding to United States District Court Civil Action No. 1:13-cv-645 (3 pages) (dated Dec. 1, 2014).
Plaintiff Precision Fabric Group Inc.'s Reply in Further Support of Its Motion to Strike the Declaration and Preclude Testimony of Dr. Wilkie corresponding to United States District Court Civil Action No. 1:13-cv-645 (15 pages) (dated Dec. 16, 2014).
Declaration of Lynne A. Borchers in Support of Plaintiff Precision Fabric Group Inc.'s Reply in Further Support of Its Motion to Strike the Declaration and Preclude Testimony of Dr. Wilkie with Exhibit 4 corresponding to United States District Court Civil Action No. 1:13-cv-645 (7 pages) (dated Dec. 16, 2014).
Memorandum Opinion and Order corresponding to United States District Court Civil Action Nos. 1:13-cv-645; 1:14-cv-650 (21 pages) (dated Jan. 15, 2015).
Motion to Reconsider Court's Claim Construction Order corresponding to United States District Court Civil Action Nos. 1:13-cv-645; 1:14-cv-650 (3 pages) (dated Sep. 29, 2015).
Brief in Support of Motion to Reconsider Court's Claim Construction Order with Exhibits A-C corresponding to United States District Court Civil Action Nos. 1:13-cv-645; 1:14-cv-650 (44 pages) (dated Sep. 29, 2015).
Response Brief in Opposition to Tietex's Motion to Reconsider corresponding to United States District Court Civil Action Nos. 1:13-cv-645; 1:14-cv-650 (10 pages) (dated Oct. 23, 2015).
Defendant's Reply Brief in Support of Motion to Reconsider Court's Claim Construction Order; Hearing Requested corresponding to United States District Court Civil Action Nos. 1:13-cv-645; 1:14-cv-650 (12 pages) (dated Nov. 5, 2015).
Plaintiff's Motion for Leave to File Surreply with Exhibit A corresponding to United States District Court Civil Action Nos. 1:13-cv-645; 1:14-cv-650 (20 pages) (dated Nov. 6, 2015).
Plaintiff's Memorandum in Support of Its Motion for Leave to File Surreply corresponding to United States District Court Civil Action Nos. 1:13-cv-645; 1:14-cv-650 (4 pages) (dated Nov. 6, 2015).
Order corresponding to United States District Court Civil Action Nos. 1:13-cv-645; 1:14-cv-650 (1 page) (dated Dec. 4, 2015).
Plaintiff's Surreply in Opposition to Defendant's Motion to Reconsider Court's Claim Construction Order corresponding to United States District Court Civil Action Nos. 1:13-cv-645; 1:14-cv-650 (6 pages) (dated Dec. 7, 2015).
Plaintiff's Motion for Partial Summary Judgment corresponding to United States District Court Civil Action Nos. 1:13-cv-645; 1:14-cv-650 (4 pages) (dated Dec. 11, 2015).
Declaration of Whitney D. Pierce in Support of Plaintiff's Motion for Partial Summary Judgment (Exhibits A-Y not included) corresponding to United States District Court Civil Action Nos. 1:13-cv-645; 1:14-cv-650 (6 pages) (dated Dec. 11, 2015).
Plaintiff's Motion to Exclude Expert Testimony of Richard Horrocks corresponding to United States District Court Civil Action Nos. 1:13-cv-645; 1:14-cv-650 (4 pages) (dated Dec. 11, 2015).
Declaration of Whitney D. Pierce in Support of Plaintiff's Motion to Exclude Expert Testimony of Richard Horrocks with Exhibit D corresponding to United States District Court Civil Action Nos. 1:13-cv-645; 1:14-cv-650 (14 pages) (dated Dec. 11, 2015).
Memorandum Order corresponding to United States District Court Civil Action Nos. 1:13-cv-645; 1:14-cv-650 (10 pages) (dated Jan. 14, 2016).
Defendant's Opposition to Plaintiff's Motion to Exclude Expert Testimony of Dr. A. Richard Horrocks with Exhibits A-C corresponding to United States District Court Civil Action Nos. 1:13-cv-645; 1:14-cv-650 (73 pages) (dated Jan. 27, 2016).
Defendant's Opposition to Plaintiff's Motion for Partial Summary Judgment (Exhibits A-S: not included) corresponding to United States District Court Civil Action Nos. 1:13-cv-645; 1:14-cv-650 (28 pages) (dated Jan. 27, 2016).
Docket Navigator Filings for: *Precision Fabrics Group, Inc.* v. *Tietex International, Ltd.* NCMD-1-13-cv-00645 (11 pages) (date accessed: Mar. 23, 2016).
Docket Navigator Filings for: *Precision Fabrics Group, Inc.* v. *Tietex International, Ltd.* NCMD-1-14-cv-00650 (9 pages) (date accessed: Mar. 23, 2016).

* cited by examiner

HEAT AND FLAME-RESISTANCE MATERIALS AND UPHOLSTERED ARTICLES INCORPORATING SAME

RELATED APPLICATIONS

This application is claims priority under 35 U.S.C. § 120 to, and is a continuation of, U.S. patent application Ser. No. 13/592,608, filed Aug. 23, 2012, which is itself a continuation of, U.S. patent application Ser. No. 11/124,968, filed May 9, 2005, abandoned, which is itself a divisional application of U.S. patent application Ser. No. 10/839,570, filed May 5, 2004, issued Dec. 19, 2006 as U.S. Pat. No. 7,150,059, which claims the benefit of priority under 35 U.S.C. § 119(e) to U.S. Provisional Patent Application No. 60/467,979, filed May 5, 2003, the disclosure of each of which is incorporated herein by reference in its entirety.

This application claims priority under 35 U.S.C. § 120 to, and is a continuation-in-part of, U.S. patent application Ser. No. 13/290,427, filed Nov. 7, 2011, issued Aug. 6, 2013 as U.S. Pat. No. 8,501,639, which is itself a continuation of U.S. patent application Ser. No. 12/172,681, filed Jul. 14, 2008, issued Aug. 5, 2014 as U.S. Pat. No. 8,796,162, which is itself a continuation of U.S. patent application Ser. No. 10/143,833, filed May 14, 2002, abandoned, which claims the benefit of priority under 35 U.S.C. § 119(e) to U.S. Provisional Patent Application No. 60/290,352, filed May 14, 2001, the disclosure of each of which is incorporated herein by reference in its entirety.

FIELD OF THE INVENTION

The present invention relates generally to fire prevention and, more particularly, to rendering upholstered articles fire resistant.

BACKGROUND OF THE INVENTION

There is heightened awareness of fire prevention in homes and businesses in the United States. This awareness has led to the development of standards and legislation directed to reducing the risk of fires, particularly with respect to bedding and upholstered furniture. Conventional fire prevention techniques for bedding and upholstered furniture involve the topical application of flame retardant chemicals directly to an outer decorative layer of upholstery material.

However, recently passed legislation may render conventional fire protection techniques for bedding (particularly mattresses) inadequate. For example, the cigarette burn test for measuring flame resistance (developed by the Upholstered Furniture Action Council) has been deemed inadequate by the state of California, and by the U.S. Consumer Product Safety Commission. In addition, new regulations being promulgated in some states prohibit the sale or manufacture of mattresses that do not pass these new flammability tests.

For example, California Technical Bulletin 603 of the State of California Department of Consumer Affairs (hereinafter "TB-603"), which is incorporated herein by reference in its entirety, exposes the top and sides of a mattress to an open gas flame to simulate the effects of burning bedclothes. TB-603 is extremely aggressive relative to conventional cigarette burn test and many industry analysts are skeptical that conventional upholstered furniture and bedding products (e.g., mattresses, etc.) will be able to pass TB-603.

In addition, material that can prevent the propagation of flame into the core cushioning material of furniture, and institutional bedding is desired. California Technical Bulletin 117 of the State of California Department of Consumer Affairs (hereinafter "TB-117"), which is incorporated herein by reference in its entirety, provides testing for upholstered furniture, and California Technical Bulletin 129 of the State of California Department of Consumer Affairs (hereinafter "TB-129"), which is incorporated herein by reference in its entirety, provides testing for institutional bedding.

In some cases, even though an upholstery fabric or ticking is constructed of inherently flame resistant material, it may be permeable such that heat and hot gases may be transmitted through the fabric causing internal materials to ignite. Furthermore, conventional methods of assembling mattresses and upholstered furniture may produce seams and joints that cannot withstand the new flammability test without splitting open and subjecting flammable interior materials to the flame. Also, pores formed in bedding fabrics as a result of sewing, seaming, quilting, or the attachment of labels, handles, decorations, vents, etc., may be penetrated by flames and hot gases which may result in the combustion of interior materials.

It is desirable to provide a thin and workable flame barrier to the upholsterer or mattress builder, to enable the incorporation of the material into thin or tightly fitting structures. Unfortunately, conventional flame resistant materials used in the mattress construction industry are very thick and heavy battings or high loft nonwoven structures, in excess of 10 ounces per square yard. These materials are difficult to use, add unacceptable bulk to the article, and are not as soft, resilient, or durable as conventional non-flame resistant cushions foams or battings.

SUMMARY OF THE INVENTION

In view of the above discussion, a mattress, foundation, or other upholstered sleep product or article, according to embodiments of the present invention, includes a core and barrier material completely surrounding the core. The barrier material includes flame and heat-resistant material that is configured to prevent combustion of the core when the upholstered article is impinged with a gas flame. In addition, the barrier material may include an intumescent material that is configured to swell and char in the presence of a flame so as to form a barrier to the flame and to heat generated by the flame. Barrier material according to embodiments of the present invention is advantageous over conventional flame-resistant materials because the barrier material of the present invention is lightweight. The lightweight barrier material of the present invention enables a manufacturer to use preferred cushioning and/or plumping materials, while still providing effective flammability performance.

Other exemplary upholstered articles that may include embodiments of the present invention include, but are not limited to, upholstered furniture, bedding products (e.g., mattresses, futons, sleeping bags, sofas, chairs, cots, etc.), automotive, aircraft and boat seating and interiors, theater seating and decorations, and any other items where cushioning may be exposed to fire.

According to embodiments of the present invention, a flame and heat resistant barrier material is provided that is capable of maintaining its flame and heat resistant integrity after being exposed to a flame for three minutes in accordance with the Precision Fabrics Group, Inc. small scale flame and heat resistant barrier panel test (the "PFG Test"). The barrier material may also include intumescent material that is configured to swell and char in the presence of a flame so as to form a barrier to the flame and to heat generated by the flame.

According to embodiments of the present invention, an article is provided that includes a backing panel having a surface, and flame and heat resistant barrier material disposed on the backing panel surface. The barrier material prevents combustion of the backing panel during and after exposure of the barrier material to a flame for three minutes in accordance with the PFG Test.

According to embodiments of the present invention, an upholstered article includes a core and a panel overlying the core. The panel includes flame and heat-resistant material that is configured to prevent or reduce combustion of the core when the exterior of the upholstered article is impinged with a gas flame in accordance with testing protocol set forth in TB-603, TB-117, and/or TB-129. The panel may include a decorative outer layer, a cushioning layer and a barrier material. The panel is configured to prevent ignition of the upholstered article, but, if ignition occurs, the panel is configured to reduce the propagation of the burning, and to reduce the intensity of the burning. This is done by several mechanisms. The first is to resist ignition itself and to self extinguish if temporarily ignited by extreme conditions. The second is to seal and block the transmission of hot gases, molten thermoplastic materials and heat. The third is to block, divert, absorb, and insulate the inside of the article from the high heat exposure on the outside. The fourth is to maintain strength after flame exposure to avoid cracking open, or breaking open at seams.

According to embodiments of the present invention, an upholstered article may include intumescent material that is configured to swell and char in the presence of a flame so as to form a barrier to the flame and to heat generated by the flame. Upon swelling and charring, the intumescent material is configured to seal openings in the upholstered article and to block the passage of flame and heat into the core thereof.

According to an embodiment of the present invention, a mattress includes a core having opposite upper and lower portions, an upper fabric panel overlying the mattress core upper portion, a lower fabric panel overlying the mattress core lower portion, and a side fabric panel extending around a periphery of the mattress core. The side fabric panel is attached along a first edge portion to the upper fabric panel and along a second edge portion to the lower fabric panel. Decorative fabric (e.g., ticking) may overlie the upper, lower and side fabric panels.

One or more of the upper, lower and side fabric panels includes flame and heat-resistant material that is configured to prevent or reduce combustion of the mattress core when the exterior of the mattress (e.g., the ticking) is impinged with a gas flame for at least about fifty seconds in accordance with testing protocol set forth in TB-603.

According to embodiments of the present invention, the upper, lower and side fabric panels include flame and heat-resistant material that is configured to prevent or reduce combustion of the core when the mattress is impinged with a gas flame for at least about three minutes in accordance with testing protocol set forth in TB-129.

According to embodiments of the present invention, the upper, lower, and side panels include flame and heat resistant material that is configured to prevent or reduce combustion of the core cushioning material of an upholstered article of furniture, when small scale tested according to TB-117.

According to embodiments of the present invention, a mattress may include intumescent material that is configured to swell and char in the presence of a flame so as to form a barrier to the flame and to heat generated by the flame. Upon swelling and charring, the intumescent material is configured to seal openings in the upper, lower and side fabric panels and to block the passage of flame and heat therethrough.

According to an embodiment of the present invention, a pillow top mattress includes a mattress core having an upper portion, a pillow top panel overlying the mattress core upper portion, a side fabric panel extending around a periphery of the mattress core, and a gusset extending around the mattress core periphery. An upper edge of the side panel is attached along a first edge portion of the gusset and an opposite second edge portion of the gusset is attached to a peripheral portion of the pillow top panel.

The gusset, upper and side fabric panels include-flame and heat-resistant material configured to prevent or reduce combustion of the mattress core when the exterior of the mattress is impinged with a gas flame for at least about fifty seconds in accordance with testing protocol set forth in TB-603. The gusset and upper, lower and side fabric panels are configured to prevent heat release from the mattress, due to combustion, and to prevent the ignition of the interior components, and to prevent the breaking open and loss of integrity of the mattress due to the effects of the flame. Additionally, the product will retain its strength after being exposed to flame that will help the seams, and other areas of construction or closure, from separating or splitting after severe flame exposure, as exemplified by the burners in TB-603. Additionally, the panels will pass the PFG Small Scale Flame and Heat Resistant Barrier Panel Test described in detail below.

According to embodiments of the present invention, a pillow top mattress may include intumescent material that is configured to swell and char in the presence of a flame so as to form a barrier to the flame and to heat generated by the flame. Upon swelling and charring, the intumescent material is configured to seal openings in the gusset, upper and side fabric panels and to block the passage of flame and heat therethrough.

DETAILED DESCRIPTION OF THE INVENTION

Figure 1:
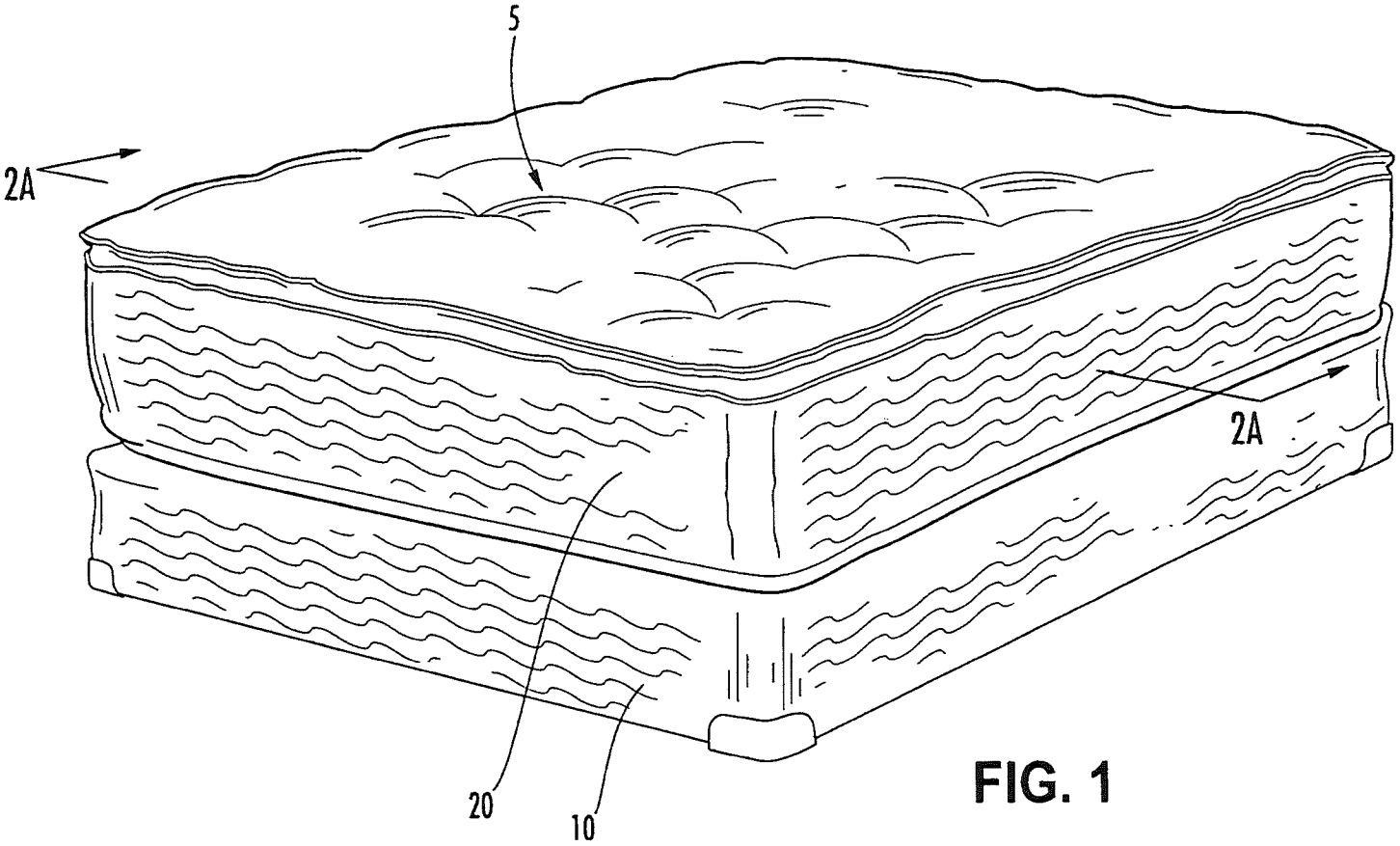
FIG. 1 is a perspective view of a pillow top mattress in which embodiments of the present invention may be utilized.

The present invention now is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

In the drawings, the thickness of lines, layers and regions may be exaggerated for clarity. It will be understood that when an element is referred to as being "on" another element, it can be directly on the other element or intervening elements may also be present. In contrast, when an element is referred to as being "directly on" another element, there are no intervening elements present. It will be understood that when an element is referred to as being "connected" or "attached" to another element, it can be directly connected or attached to the other element or intervening elements may also be present. In contrast, when an element is referred to as being "directly connected" or "directly attached" to another element, there are no intervening elements present. The terms "upwardly", "downwardly", "vertical", "horizontal" and the like are used herein for the purpose of explanation only.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention. As used in the description of the invention and the appended claims, the singular forms "a", "an" and "the" are intended to include the plural forms as well, unless the context clearly indicates otherwise. All publications, patent applications, patents, and other references mentioned herein are incorporated by reference in their entirety.

As used herein, phrases such as "between X and Y" and "between about X and Y" should be interpreted to include X and Y.

As used herein, phrases such as "between about X and Y" mean "between about X and about Y."

As used herein, phrases such as "from about X to Y" mean "from about X to about Y."

As used herein, the term "and/or" includes any and all combinations of one or more of the associated listed items.

As used herein, the term "flame resistant material" means a material that passes the requirements of National Fire Protection Association (NFPA) 701-1989.

As used herein, the term "heat resistant material" means a material that does not melt, ignite, or decompose up to a temperature of 250° C. at ambient atmospheric oxygen levels.

According to embodiments of the present invention, barrier materials for use within home and public building furnishings such as upholstered furniture, bedding products (e.g., mattresses, futons, sleeping bags, cots, etc.), automotive, aircraft and boat seating and interiors, theater seating and decorations, and any other items where cushioning may be exposed to fire, are provided that can withstand the intense flames of the various new state and federal tests and prevent underlying materials from igniting. The specific test is determined by the end use and the location of the product use. In many cases, the testis run on the complete system, such as a bedding set, a futon, a couch, etc. By using a coating, or a chemical finish that tends to seal a structure, embodiments of the present invention can more effectively prevent ignition than conventional fire resistant fabrics. Sealing may be done initially with a coating, or the coating may be configured to swell upon exposure to high temperature and flame in order to seal apertures or other potential pathways for flames and/or heat.

Barrier materials for use within bedding products and other upholstered furniture, according to embodiments of the present invention, have low air permeability under ASTM D737-96: Frasier Air Permeability (e.g., less than 200 cfm). Coated barrier fabrics according to embodiments of the present invention insulate foam and other materials from radiant, convective and conductive heat. Coated barrier fabrics according to embodiments of the present invention have a closed web to prevent the passage of convective heat, conductive heat and molten polymer. The insulating properties of coated barrier materials according to embodiments of the present invention shield underlying combustible materials from flame and the possibility of ignition. In some embodiments, inorganic intumescent material may be employed. Mattresses and other upholstered furniture, according to embodiments of the present invention, also utilize materials that are flame and heat resistant so as to prevent rupture during exposure to flame and heat.

Barrier materials for use within bedding products and other upholstered furniture, according to embodiments of the present invention, are configured to pass the PFG Small Scale Flame and Heat Resistant Barrier Panel Test set forth below.

PFG Small Scale Flame and Heat Resistant

Barrier Panel Test

SCOPE: The PFG test is intended to quickly evaluate the performance of a material that will be used as a flame protective barrier panel for bedding and upholstered furniture and other articles.

PROCEDURE:

1. Obtain a sample of the material to be tested. Condition this material at 70° F. and 65% RH for at least two hours before testing.
2. Cut 14"×14" specimens from the sample. At least two specimens must be evaluated.
3. In a metal rack, clamp the barrier material atop a 2 inch thick panel of 1.8 density non flame retardant urethane foam. (Prior to clamping, position a thermocouple between the barrier material and foam to measure temperature.) The metal rack is equipped with pins along the perimeter of the rack to constrain the fabric and is configured to slightly compress the foam and barrier material assembly along the circumference, with the inside dimension being 1.89" when clamped.
4. Hang the metal rack containing the foam and barrier material assembly vertically, in a hood or chamber that will contain the smoke and fumes from burning.
5. Assemble a burner module per California Technical Bulletin 129, (which is incorporated herein by reference in its entirety).
6. Equip the burner module with a source of propane and a flowmeter, (mass flow meter or rotameter) to deliver 4.7 liters per minute.
7. Ignite the burner and adjust the gas flow to the specified amount.
8. Apply the flame horizontally, with the burner orifices 1" away from the barrier material, four inches from the bottom of the exposed barrier material.
9. Allow the flame exposure to continue for three minutes.
10. Remove the flame and observe the barrier material for cracks and note any after flame or ignition of the backing foam.
11. After allowing the specimen to cool, remove it from the assembly and evaluate for cracking or physical failure RESULTS: Barrier material that passes the PFG Test does not crack open or otherwise lose flame and heat resistant integrity during or immediately after flame exposure. The char strength of a burned sample of material that passes this test is greater than or equal to about 2 Newtons. In addition, material that passes this test prevents the temperature behind the material (i.e., on the other side of the material from the flame) from reaching and exceeding about 350° C. after about 50 seconds of flame ,exposure.

Char strength, as used herein, is defined as the strength remaining in a fabric, laminate, composite, quilted panel, or other sheet structure after being exposed to heat, fire, or both. Char strength is tested on a ring softness tester, by measuring the burst strength in Newtons recorded when a plunger is forced through the fabric, as described below.

Standard Test Method for PFG Circular Bend

Char Strength Test

This test method is used to determine the char strength of chemically treated or non-treated woven, non-woven or laminated fabric after a flammability test has been conducted. This method provides useful information with regards to the char strength of specimens after impingement using PFG Small Scale TB-129 test or PFG Small Scale TB-603 Test.

According to the test method, the center of the charred area of a material is placed under a motorized, instrumented plunger and forced through a hole in a plate. The force, in Newtons, required to bend and force the charred material through the hole, is determined. The apparatus used to do this is a J. A. King circular bending test apparatus. Test material is conditioned in standard atmosphere at 70° F. and 65% RH prior to testing. The number of test samples is determined by article sampling plan and number of lanes to test per sample. One test is conducted for each specimen burned. The test procedure is as follows:

1. Turn on the circular bend tester by pressing the "ON" button. Hold on until numbers appear.
2. Check the air pressure gauge to the left of the instrument to be sure air is on. Pressure should read about 45 psi.
3. If necessary, press the "UNIT" key repeatedly until "N" (Newtons) units appear.
4. If necessary, press the "PEAK" key repeatedly until "C Peak" appears. Screen should now read: C peak 0.000 N.
5. Carefully slide the sample, under the plunger. Position center of charred area directly under instrumented plunger. If plunger is bumped, a N value will appear. If this happens, press the "ZERO" key to clear.
6. Press and hold the two blue buttons until the sample completely passes through the hole and falls out. (If charred area is flexible and the plunger does not break through, specimens tested must be clamped on both sides to the edge of the support plate).
7. Release buttons and record N value.
8. Press the "ZERO" button to prepare for the next test.
9. When finished, press the "OFF" button.
10. Report the individual and average Newton results.

As illustrated in FIG. 1, an exemplary mattress assembly 5 includes a foundation (e.g., a box spring mattress) 10 and a top or inner spring mattress 20. One type of top or inner spring mattress that has become popular is known as a "pillow top" mattress. A pillow top mattress conventionally includes an enclosure, containing a cushioning material that is attached to an upper deck of a mattress core, either as a separate cushion or sewn directly to the side panel of the mattress or foundation.

Figure 2A:
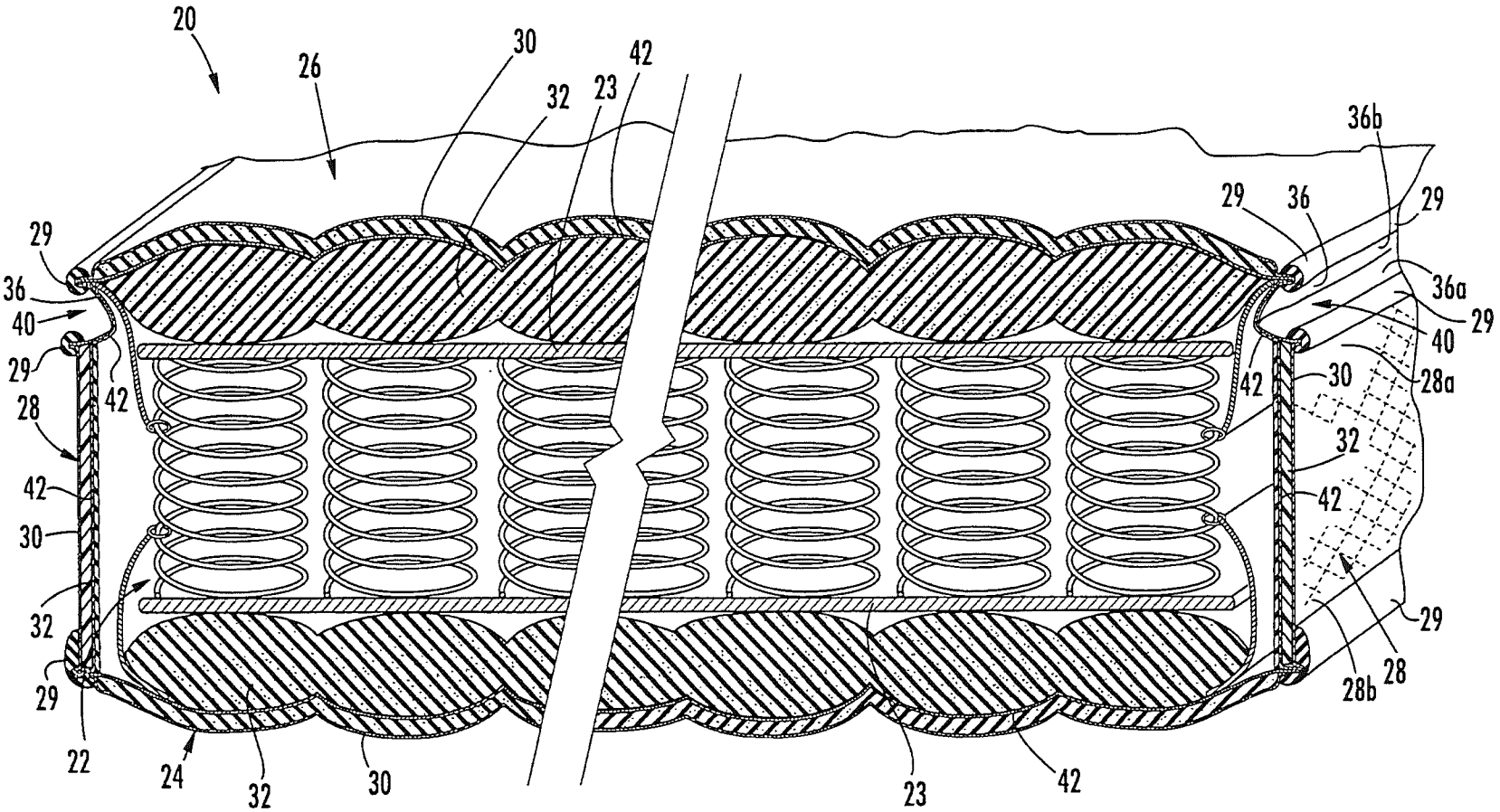
FIG. 2A is a cross-sectional view of the pillow top mattress of FIG. 1, taken along lines 2A-2A.
Figure 2B:
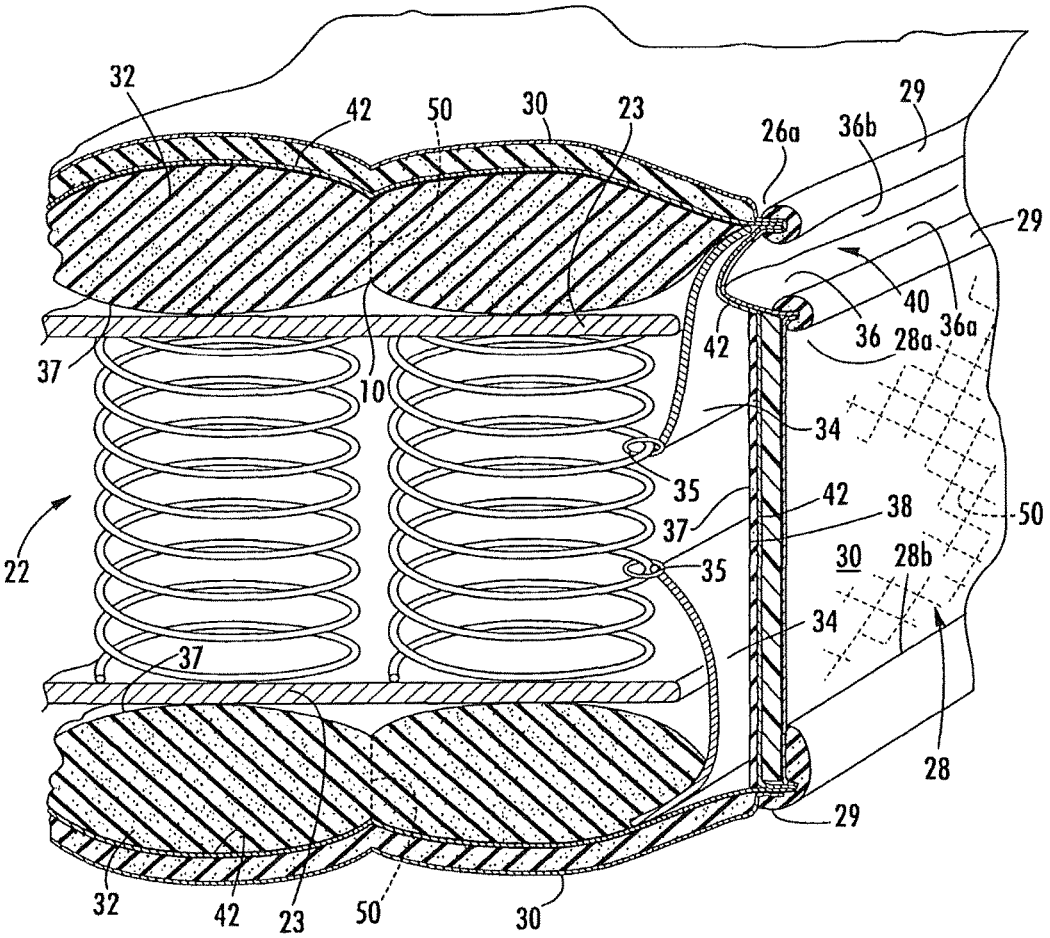
FIG. 2B is an enlarged partial view of the pillow top mattress of FIG. 2A.

A pillow top mattress assembly in accordance with embodiments of the present invention is illustrated in cross-section in FIGS. 2A-2B and is designated generally by the reference numeral 20. The mattress assembly 20 includes a mattress core 22 which may be constructed of a variety of resiliently compressible materials (e.g., springs, foam, etc.).

The illustrated mattress core 22 is surrounded by an insulator 23. A lower cushioning panel 24 is attached to the lower portion of the mattress core 22, a pillow top panel 26 overlies, and is attached to the upper portion of the mattress core 22, and side panels 28 extend around the periphery of the mattress core 22 and are attached to the lower cushioning panel 24 and to the pillow top panel 26. A gusset 36 extends around the mattress core periphery, as illustrated. An upper edge 28*a* of the side panel 28 is attached along a first edge portion 36*a* of the gusset 36. An opposite second edge portion 36*b* of the gusset is attached to a peripheral portion 26*a* of the pillow top panel 26. The gusset configuration provides an indentation or pocket 40 that extends around the mattress 20.

The gusset 36 may be folded or pleated in such a way as to create the appearance that the pillow top panel 26 is resting separately atop the mattress 20. However, according to other embodiments of the present invention, the gusset 36 may be configured to give the appearance that the, pillow top panel 26 is directly attached to the mattress upper portion. According to embodiments of the present invention, the gusset 36 may be removably attached to pillow top panel 26 (e.g., via a zipper) to facilitate removal of the pillow top panel 26.

A decorative fabric, referred to as "ticking" 30 covers the outside of the pillow top panel 26, the lower cushioning panel 24 and the side panels 28, as illustrated. In the illustrated embodiment, the ticking 30 of the lower cushioning panel 24 is connected to the ticking 30 of the side panels 28 via a sewn seam covered by seam tape 29.

In the illustrated embodiment, the pillow top panel 26 also includes a layer of barrier material 42, cushion material (e.g., foam, batting, etc.) 32, and a carrier or scrim layer 37. The ticking 30, barrier material 42, cushion material 32 and scrim layer 37 are quilted together (indicated by 50) to form the pillow top panel 26.

The illustrated lower cushioning panel 24 includes a layer of barrier material 42, cushion material (e.g., foam, batting, etc.) 32, and a carrier or scrim layer 37. The ticking 30, barrier material 42, cushion material 32 and scrim layer 37 are quilted together (indicated by 50) to form the lower cushioning panel 26.

The illustrated side panels 28 include a layer of barrier material 42, cushion material (e.g., foam, batting, etc.) 32, and a carrier or scrim layer 37. The ticking 30, barrier material 42, cushion material 32 and scrim layer 37 are quilted together (indicated by 50) to form the side panels 28.

In the illustrated embodiment, flanges 34 are utilized to connect the pillow top panel 26 with the mattress core 22 and the lower cushioning panel 24 with the mattress core 22. The flange 34 is connected to the pillow top panel 26 with a sewn seam and then connected to the mattress core 22 using a metal ring 35 referred to as a "hog ring". Similarly, the flange 34 is connected to the lower cushion panel 24 with a sewn seam and then connected to the mattress core 22 using a hog ring 35.

The barrier material 42 in the illustrated pillow top panel 26, lower cushion panel 24, and side panels 28 is formed from flame and heat-resistant material that is configured to prevent or reduce combustion of the mattress core 22 when the exterior of the mattress 20 is impinged with a gas flame according to various state and federal tests. For example, the barrier material 42 can prevent or reduce combustion of the mattress core 22 when the mattress exterior (ticking 30) is impinged with a gas flame for at least about fifty seconds in accordance with testing protocol set forth in TB-603. Moreover, the barrier material 42 prevents heat release rate from the mattress core 22, due to combustion, from exceeding 200 kW in 30 minutes, and prevents the heat release rate, due to combustion, from exceeding 25 MJ within 10 minutes of the mattress exterior being impinged with the gas flame.

The barrier material 42 is configured not to ignite or propagate flame, and not to shrink, crack or break open, or melt away from a flame source. The barrier material 42 may be formed from various flame and heat resistant materials including, but not limited to, woven fabrics, nonwoven fabrics, knitted fabrics, films, laminates, and flexible composites, and combinations thereof. While a nonwoven fabric is preferred for substrates according to embodiments of the present invention, woven fabrics, braided fabrics, knitted fabrics, tufted fabrics, flocked fabrics, worplex fabrics, papers, and/or combinations thereof could be used.

Exemplary nonwoven fabrics include needle punched fabric, spunbonded fabrics, thermal bonded fabrics, spunlaced fabrics, resin bonded fabrics, stitch bonded fabrics and meltblown fabrics. Exemplary fabric fibers include, but, are not limited to, thermoplastic and thermosetting fibers, and particularly temperature resistant fibers such as glass, asbestos, carbon, polyphenylene benzobisoxazole, polybenzimidazole, paraaramids, meta-aramids, fluorocarbons, polyphenylene sulfides, melamines, and polyimides. Synthetic fibers, such as polyester, may be blended to improve strength and/or dimensional stability of the flame-resistant substrate. Weight, blend ration, and thickness of the material may be determined by the manufacturing process.

For nonwoven fabric, the product should be uniform and if a flame retardant or intumescent is required, it should be capable of holding the effective amount in its structure. The use of needlepunched, or spunlaced fabrics offer a wide variety of fiber choices and do not require thermoplastic fiber to form the substrate. Woven and knitted materials can offer many of the same advantages if the appropriate fiber blends are utilized.

For the addition of strength to nonwoven fabrics, for use in flanges or other areas where high strength is needed, the fiber(s) can be formed into a batt or fabric web and then stitchbonded using the appropriate yarn.

Flame and heat-resistant fibers utilized in the barrier material 42 include, but are not limited to, glass, aramid, polytetrafluoroethylene (PTFE), basalt, carbon, polyimide, phenolformaldehyde, polybis-imidazole, polyvinylidene chloride, ceramic, graphite, polysulfide, melamine, silicon carbide, and blends thereof. Blends of cellulosic fibers (e.g., rayon, cotton and woodpulp) and at least one type of flame and heat-resistant fiber may be utilized.

Exemplary fibers that would be particularly useful to manufacture fabric substrates according to embodiments of the present invention include, but are not limited to, cellulose-based fibers such as viscose, silicic modified viscose, rayon, cotton, flax, lyocell, ramie, and wood pulp, and the silicic acid modified rayon marketed under the VISIL® brand. Other non-thermoplastic fibers such as wool, polylactic acid, melamine, modacrylic, and acrylic, may be used.

According to embodiments of the present invention, the barrier material 42 is formed from materials that have been rendered flame resistant and high temperature resistant through the application of flame retardant chemicals. Flame retardant chemistry utilized in accordance with embodiments of the present invention includes, but is not limited to: borates such as boric acid, zinc borate or borax; sulfamates; phosphates such as ammonium polyphosphate; organic phosphorous compounds; halogenated compounds such as ammonium bromide, decabromodiphenyl oxide, or chlorinated paraffin; inorganic hydroxides such as aluminum or magnesium hydroxide, antimony compounds, and silica or silicates.

Boron compounds coat a fiber with a glassy film to insulate the polymer being protected. These compounds may increase the combustion temperature of the fuels and/or interfere with their flame chemistry.

Phosphorous compounds react with fibrous materials to prevent the formation of volatiles, which act as fuel to a flame. In addition, these compounds may promote the formation of char.

Nitrogen compounds alone are generally not good flame retardants. However, they may synergistically enhance the effects of phosphorous compounds to provide flame retarding effects.

Halogen compounds scavenge hydrogen and hydroxyl free radicals, thus breaking down the combustion chain reaction caused by these radicals.

Commercial products that may be used according to embodiments of the present invention are listed below in Table 1 with their chemical nature and manufacturer. This list includes several of the many possible commercial products that may be used as a flame retardant according to embodiments of the present invention. Other available products may also be used. Many of the listed chemicals may be mixed with selected binders to add hand or durability to the finished flange material. These binders may also aid the barrier chemistry described below.

TABLE 1

| Product | Chemical Nature | Manufacturer |
|---|---|---|
| SPARTAN 590 | Organic/Inorganic Phosphate blend | Spartan Flame Retardants |
| SPARTAN 880 | Organic/Inorganic Phosphate blend | Spartan Flame Retardants |
| SPARTAN AR371 | Organic/Inorganic Phosphate blend | Spartan Flame Retardants |
| APEX FLAMEPROOF 487 | Organic Phosphate Ammonia Salt | Apex Chemical Corporation |
| APEX FLAMEPROOF 2477 | Organic Phosphate Ammonia Salt | Apex Chemical Corporation |
| ANTIBLAZE N | Cyclic Phosphorous Compound | Rhodia |
| ANTIBLAZE NT | Cyclic Phosphorous Compound | Rhodia |
| GUARDEX FRC-PHN | Phosphorous/Nitrogen Derivatives | Glo-tex International, Inc. |
| GUARDEX FRC HV-NF | Proprietary Compound | Glo-tex International, Inc. |
| PYROZYL PCN | Phosphoric Acid/Ammonia | Amitech, Inc. |
| E-20602 | Proprietary Compound | High Point Textile Auxiliaries |
| APEX 344-HC | Halogenated Compound/ Antimony Oxide | Apex Chemical Corporation |
| HIPOFIRE BRA | Decabromodiphenyloxide/ Antimonytrioxide | High Point Textile Auxiliaries |
| General Chemicals | Monophosphate, diammonium phosphate, ammonium sulfamate, ammonium borate, ammonium bromide, urea, pentabromodiphenyl oxide, chlorinated paraffin | Assorted manufacturers |

According to embodiments of the present invention, the ticking 30 may also be formed from flame resistant material and/or may be treated with flame retardant material.

According to embodiments of the present invention, the barrier material utilized in the gusset 36, side panels 28 and pillow top panel 26 may include an intumescent material that is configured to swell and char in the presence of a flame so as to form a barrier to the flame and to heat generated by the flame. The intumescent material, upon swelling and charring, is configured to seal openings in the gusset 36, pillow top panel 26 and side panels 28 (e.g., thread holes, apertures for vents and handles, etc.) and to block the passage of flame and heat therethrough.

Intumescent compounds in accordance with embodiments of the present invention may be organic materials or inorganic materials, and may be combined with a spumific or "blowing agent" to enhance foaming and insulation properties. Suitable intumescent materials include, but are not limited to, melamine, pentaerythritol, vermiculite, fluorocarbon, graphite, bentonite, clay, phosphated melamine, borated melamine, sugars, and polyols. The combination of flame retardants and intumescent agents is specifically advantageous because the intumescent will tend to swell and therefore seal apertures or breaches in the flame blocking material that are formed from sewing, seaming or attachment.

U.S. Pat. No. 5,645,926 to Horrocks et al. describes a flexible fire and heat resistant material comprising an intimate mixture of organic intumescent filler and organic fibres adapted to char intensely within the temperature range of 200° C. to 500° C., and is incorporated herein by reference in its entirety.

The property of swelling and sealing the openings in the flame blocking layers is useful whether the flame resistant layer is an inherently resistant fabric or a fabric that has been rendered flame resistant via treatment with a flame retardant chemistry. The holes formed in the construction of the gusset, flange, seam tape, or quilting of a mattress or other cushioned article, can be sealed by the action of the intumescent. The intumescent will also swell when exposed to heat or flame and reduce the permeability of the fabric, thereby improving the flame blocking capability.

An intumescent coating may be applied to material as a lightweight and porous foam or froth using conventional coating techniques such as a knife coater, a roll coater, spray coating, calendering, transfer coating or screen printing. Various intumescent compounds are known and one particular suitable class of intumescent compounds comprises a source of carbon (i.e., a carbonific compound), a catalyst, and a source of nonflammable gas (i. e. , a foaming or blowing agent). Exemplary carbonific compounds include carbohydrates, proteins or polyfunctional alcohols such as starch, casein or pentaerythritol. On exposure to flame, the catalyst causes the carbonific compound to swell and char. Exemplary catalysts include inorganic acids such as boric, phosphoric, or sulfuric acid, or may include compounds which on decomposition form an inorganic acid such as mono- or diammonium phosphates, melamine, and urea.

The source of non-flammable gas for foaming the intumescent coating may be provided by the catalyst, for example if melamine is used as the catalyst, or alternatively be provided by a compound which upon exposure to a flame evolves the gas such as ammonia, carbon dioxide or hydrogen chloride. The intumescent composition may be compounded with binders and thickeners and the like to aid in the specific application of the coating. Additionally, conventional flame retardant fillers such as alumina trihydrate, silicates, kaolin, gypsum and hydrated clay may be added.

When material having an intumescent coating according to aspects of the present invention is exposed to high temperature and/or a flame, the intumescent coating reacts and swells to form a char which closes the pores of the coating itself and fills pores or interstices in the flange substrate. The char is substantially incombustible and has cellular characteristics. The char thus acts as a flame barrier and limits the penetration of flames and hot gases through the flange substrate to ignite the underlying flammable material.

Table 2 lists several intumescent products that may be used in accordance with embodiments of the present invention. Other available products may also be used. Although all of these products are proprietary compounds, they all use the intumescent mechanism described above. Some are designed to be applied as a coating, while others may be padded on the fabric.

TABLE 2

Exemplary Intumescent Finishes

| Product | Application Method | Manufacturer |
|---|---|---|
| Spartan 982 | Coating | Spartan Flame Retardants |
| Glotard BFA | Pad | Glo-tex International, Inc. |
| Pyromescent 3901 | Coating | Amitech, Inc. |
| Unibond 1114 | Coating | Unichem, Inc. |
| Glotard FRC BJ-M | Coating | Glo-tex International, Inc. |
| Glotard W263A | Pad | Glo-tex International, Inc. |

According to embodiments of the present invention, a thermally protective, flame retardant barrier material may be formed by applying a flame retardant chemical to a fabric substrate, applying a finish comprising an intumescent coating to the fabric substrate, and then drying the fabric substrate. The finish may further include a colorant. The presence of the colorant may allow the fabric substrate to be dyed to a desired color and/or in a desired pattern.

The flame retardant chemical may be applied by a method chosen from pad application, foamed application, gravure or kiss coat application, or spray application.

Other known chemical application techniques may also be used. The application of the flame retardant chemical may prevent ignition of the barrier material 42 and/or propagation of a flame when the barrier material 42 is exposed to a flame. In one embodiment, the flame retardant chemical is applied to the fabric substrate in an amount ranging from 5 to 100% solids by weight based on the weight of the flange material. In another embodiment, the flame retardant chemical is applied to the fabric substrate in an amount ranging from 35 to 85% solids by weight based on the weight of the flange material.

The finish comprising an intumescent coating may be applied by a method chosen from pad application, spray application, knife application, roller application, and die coating. Other known chemical application techniques may also be used. The intumescent coating may be foamed and/or frothed depending on the stability of the foam. In one embodiment, the finish is applied to the fabric substrate in an amount ranging from 5 to 200% solids by weight based on the weight of the flange material. In another embodiment, the finish is applied to the substrate in an amount ranging from 15 to 50% solids by weight based on the weight of the flange material.

The fabric substrate may be dried by means of a tentered oven and/or other known fabric drying means.

The barrier material 42 includes a front surface and a back surface. The front surface is the coated side, which would face outwards from a mattress core and pillow top (or outward from a side panel or lower cushion panel) and be impinged by flame or heat.

One preferred embodiment is a fabric substrate that is coated with a mixture of polymer binder and expandable graphite. Typically, expandable graphite is treated with acid to facilitate expansion when exposed to heat. When using fabrics coated with graphite particles, expansion of the graphite can be from 10 to over 200 times the original volume. As such protection of the fabric and core materials of an upholstered article can be improved.

Coatings using graphite material will typically contain from 5% to 50% graphite solids on the weight of the total coating solids. A preferred range would be from 15 to 35%. Suitable graphites include, but are not limited to, the Signature® graphite powders from Superior Graphite Corporation. Both the 80 mesh and 50 mesh sizes are effective. Additionally, the treated graphite may be coated to have a neutral or basic pH which can help in handling and compounding.

The graphite coating may be applied as a paste and/or as a foam. The foamed compounds are superior in response to flame and do not adversely affect the aesthetic properties of a fabric, such as softness and color. Materials produced using this technology pass the PFG Test.

Specific Mattress Embodiments

The following are specific mattress construction embodiments of the present invention.

1. Construct the seam tape, flange, gusset, or side panel from inherently flame and heat resistant materials.

2. The seam tape, flange, gusset, ticking, and areas of sewn attachments are constructed from an inherently flame and heat resistant material, which is treated, finished, coated or impregnated with an intumescent.

3. The seam tape, flange, gusset or side panel are constructed from a predominately non-thermoplastic material that is treated for flame resistance with a chemical flame retardant.

4. The seam tape, flange, gusset, side panel, ticking, and areas with sewn attachments are constructed from a predominately non-thermoplastic material that is treated, finished, coated, or impregnated for flame resistance with a chemical flame retardant and an intumescent.

5. The ticking, filler cloth, upholstery fabric or any surface area is covered with a laminate of an inherently flame resistant material, or a flame retardant treated material, or a flame resistant or flame retardant material that is also treated with an intumescent chemical.

EXAMPLES

Example 1

Greige (i.e., unfinished) fabric was a 3.7 osy needlepunched 70/30 Rayon/Polyester blend. The polyester used was a 4.75 denier by 3" staple fiber and the rayon was a 3.0 denier by 2 ½" fiber. The fabric was finished with the formulations listed in Table 3. The finish was applied in a pad application with the pad set to a pressure of 3.5 bar and speed of 2.8 m/min.

TABLE 3

Example 1 Pad Finish Properties

| Chemical | Concentration | Wet Pick-Up | Dry Add-On |
|---|---|---|---|
| APEX FLAMEPROOF 2487 | 100% | 160% | 73% owf |

The intumescent coating was applied as listed in Table 4.

TABLE 4

Example 1 Froth Coating Properties

| Chemical | Concentration | Dry Add-On |
|---|---|---|
| SPARTAN 982 FR | 100% | 41% owf |

The SPARTAN 982 FR compound contains a foaming that allows the product to be foamed to a semi-stable froth. This mixture is foamed using a kitchen mixer. The coating method is knife over roller. There is no gap between the knife blade and the fabric.

The finished fabric is dried in a Werner-Mathis lab-scale force air oven at 300° F. for 30 seconds. The flame retardant and TPP performances of the example are listed in Table 5.

TABLE 5

Example 1 Performance Properties

| Finished Weight (osy) | Tol. Time to $2^{nd}$ Degree Burn | TPP (contact) | TPP Efficiency (contact) | NFPA 701 Char Length | NFPA 701 After Flame | NFPA 701 # of Drips |
|---|---|---|---|---|---|---|
| 7.95 | 6.04 sec | 11.95 | 1.50 | 2.75" | 0 sec. | 0 |

The TPP value reported in Table 5 is yielded from a contact test. The TPP value and TPP efficiency (TPP value/Finished Weight) of Example 1 are higher than that of NOMEX IIIA or INDURA.

Example 2

Greige fabric is the same greige used in Example 1. The fabric was finished using the formula listed in Table 6.

TABLE 6

Example 2 pad Finish Properties

| Chemical | Concentration | Wet Pick-Up | Dry Add-On |
|---|---|---|---|
| GLOTARD BFA | 60% | 270% | 43% owf |
| GUARDEX FRC | 36% | 270% | 62% owf |
| HV-NF Water | 4% | 270% | N/A |

The finish was applied in a pad application with a pad pressure of 3.5 bar at 2.8 m/min. The saturated fabric was then dried in a Werner-Mathis lab-scale forced air oven at 300° F. for 30 seconds. The flame retardant and TPP performances of this sample are presented in Table 7.

TABLE 7

| Example 2 Performance Properties | | | | | | |
|---|---|---|---|---|---|---|
| Finished Weight (osy) | Tol. Time to 2nd Degree Burn | TPP (contact) | TPP Efficiency (contact) | NFPA 701 Char Length | NFPA 701 After Flame | NFPA 701 # of Drips |
| 7.5 | 6.25 | 12.38 | 1.63 | 3.375" | 0 sec. | 0 |

The TPP value reported in Table 7 is also the result of a contact test. The TPP value and TPP efficiency of Example 2 are higher than those of NOMEX IIIA and the fabric of Example 1.

The finish formulations may be altered to use different chemicals or to adjust the add-on amounts of each chemical.

In addition to heat from flames, barrier material according to embodiments of the present invention may also provide protection from the pulse of heat generated by an electrical arc. The heat attenuation factor (HAF) obtained from testing standard ASTM F-1959-99 is used to quantify the transfer of heat through a protective layer, such as a thermally protective, flame retardant fabric. The HAF is a measure of the ability of a material to inhibit the transmission of heat and is stated as a percentage. In one embodiment, the fabric has an HAF according to ASTM F-1959-99 of at least 70%. In another embodiment, the fabric has an HAF according to ASTM F-1959-99 of at least 85%.

The energy breakthrough threshold (Ebt) of a fabric is a measure of the energy in calories per square centimeter ($cal/cm^2$) a fabric can withstand without breaking open and while preventing a second degree burn. In one embodiment, the fabric has an Ebt of at least 8.0 $cal/cm^2$. In another embodiment, the fabric has an Ebt of at least 14.0 $cal/cm^2$. With these Ebt levels, the fabric of the present invention qualifies for use in a Category II environment under NFPA70E, the Standard for Electrical Safety Requirements for Employee Workplaces (2000).

Example 3

A 3.5 osy needlepunched nonwoven fabric was produced using a blend of non-thermoplastic fibers as follows: Rayon, 45%; Lyocell, 45%; Para-aramid, 10%. The fabric was treated with GLO-TARD PFG, an intumescent, flame retardant coating manufactured by Glo-tex Corporation. An acrylic binder, GLO-CRYL NE, was added to increase durability. The formula contained 53% GLO-TARD PFG and 7% GLO-CRYL NE. The remaining constituent was water. The fabric was dipped in the chemical bath and nipped to reduce the wet pick-up to 124%. The performance properties of this sample are presented in Table 9.

TABLE 9

| Example 4 Performance Properties | | |
|---|---|---|
| Finished Weight (osy) | TPP (contact) | TPP Efficiency (contact) |
| 5.66 | 12.53 | 2.21 |

As shown, the resulting fabric had a finished basis weight of 5.66 osy. In addition, the resulting TPP value for this product was 12.53, with a TPP efficiency of 2.21.

Example 4

A 4.0 OSY needle punched nonwoven fabric composed of 70% Visil™ fiber, 20% Lyocell fiber and 10% para-aramid fiber was obtained from American Nonwovens Corp.

The fabric was finished with a 35% solution of a phosphate-urea type flame retardant designated as FR-590, from Spartan Chemical Corp. This fabric was dipped in the solution and then nipped to about 150% wet pick up and then dried in a tenter frame at 275° F. for about 1.25 minutes. The finished fabric weighed 5.4 OSY.

The finished fabric was then coated with an intumescent flame retardant coating comprised of acrylic binder, graphite, water and foaming surfactant, and was designated Performax 3803 from Noveon Corp. The coating contained approximately 27% graphite. The coating was foamed to a blow ratio of 1.9:1, and coated onto the finished fabric to achieve a solids add on averaging 4 OSY. The finished product averaged 9.4 OSY.

The finished coated fabric showed excellent flammability properties when tested with the PFG Small Scale Flame and Heat Resistant Barrier Panel Test and when used in the side panels of a properly constructed mattress, the mattress passed TB-603.

Example 5

A needle punched fabric was prepared from 45% Visil fiber, 45% Lyocell fiber, and 10% para-aramid fiber, at a basis weight of 7.5 OSY.

The fabric was dipped in a flame retardant bath containing about 25% of a salt type phosphate mixture and nipped to a wet pick-up of about 100%.

The fabric was then tenter frame dried to a final basis weight of 9.4 OSY.

This fabric gave excellent flame response, showed no cracking or foam ignition in the PFG Small Scale Flame and Heat Resistant Barrier Panel Test, and mattresses using this fabric passed TB-603.

Example 6

A 4.1 OSY rayon nonwoven, stitchbonded with nylon yarn was obtained from Grupo Frati in Italy. This fabric was finished with a 22% solution of a blend of Ammonium polyphosphate and acrylic binder, designated Performax 3845 from Noveon Corp.

The fabric was dipped in the finish and dried to a final basis weight of 5.6 OSY, a 37% add-on, owf.

The physical properties were as follows:

Physical Properties:

| | |
|---|---|
| Air permeability (Frazier) | 130 |
| Basis Weight (osy) | 5.63 |
| Thickness (in) | 0.027 |

-continued

| | |
|---|---|
| Grab Tensile (lbs) - MD | 28.6 |
| Grab Tensile (lbs) - XD | 90.1 |
| Elongation (%) - MD | 48.3 |
| Elongation (%) - XD | 33.9 |
| HOM (g) - MD | 43.4 |
| HOM (g) - XD | 10.9 |
| Thermal Shrinkage (%) - MD | 14.5 |
| Thermal Shrinkage (%) - XD | 4.5 |
| Width (in) | 72.25 |

The fabric was used to build a mattress, and was used for the filler cloth portion. Material specimens tested passed the PFG Small Scale Flame and Heat Resistant Barrier Panel Test with no cracking or foam ignition. TB-603 testing was successful.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention.

That which is claimed:

1. A barrier material consisting of a single layer of a needle punched nonwoven fabric, wherein the needle punched nonwoven fabric comprises cellulosic fibers and polyester fibers, has a basis weight ranging from about 3 to about 8 ounces per square yard, and is treated with a flame retardant finish or coating, wherein the flame retardant finish or coating comprises one or more compounds selected from the group consisting of phosphorous compounds and nitrogen compounds, wherein the flame retardant finish or coating is applied to the needle punched nonwoven fabric in an amount ranging from about 15 to about 130 percent solids, based upon the weight of the needle punched nonwoven fabric, and wherein the barrier material has a thickness ranging from about 0.01 to about 0.15 inches.

2. The barrier material of claim 1, wherein said cellulosic fibers comprise one or more regenerated cellulose fibers.

3. The barrier material of claim 1, wherein said cellulosic fibers comprise viscose fibers.

4. The barrier material of claim 1, wherein said cellulosic fibers comprise silicic modified viscose fibers.

5. The barrier material of claim 1, wherein said cellulosic fibers comprise lyocell fibers.

6. The barrier material of claim 1, wherein said cellulosic fibers comprise one or more fibers selected from the group consisting of cotton fibers and wood pulp fibers.

7. The barrier material of claim 1, wherein said needle punched nonwoven fabric further comprises one or more thermoplastic fibers.

8. The barrier material of claim 1, wherein said needle punched nonwoven fabric further comprises one or more fibers selected from the group consisting of aramid fibers, basalt fibers, melamine fibers, carbon fibers, acrylic fibers, modacrylic fibers, polyphenylene sulfide fibers, fluorocarbon fibers, and polyimide fibers.

9. The barrier material of claim 1, wherein said barrier material maintains flame- and heat-resistant integrity when impinged with a gas flame in accordance with the testing protocol set forth in Technical Bulletin 603 of the State of California Department of Consumer Affairs (TB-603).

10. A barrier material consisting of a single layer of a needle punched nonwoven fabric, wherein the needle punched nonwoven fabric comprises cellulosic fibers and polyester fibers, has a basis weight ranging from about 3 to about 8 ounces per square yard, and is treated with a flame retardant finish or coating, wherein the flame retardant finish or coating comprises clay and one or more compounds selected from the group consisting of phosphorous compounds and nitrogen compounds, wherein the flame retardant finish or coating is applied to the needle punched nonwoven fabric in an amount ranging from about 15 to about 130 percent solids, based upon the weight of the needle punched nonwoven fabric, and wherein the barrier material has a thickness ranging from about 0.01 to about 0.15 inches.

11. The barrier material of claim 10, wherein said cellulosic fibers comprise one or more regenerated cellulose fibers.

12. The barrier material of claim 10, wherein said cellulosic fibers comprise viscose fibers.

13. The barrier material of claim 10, wherein said cellulosic fibers comprise silicic modified viscose fibers.

14. The barrier material of claim 10, wherein said cellulosic fibers comprise lyocell fibers.

15. The barrier material of claim 10, wherein said cellulosic fibers comprise one or more fibers selected from the group consisting of cotton fibers and wood pulp fibers.

16. The barrier material of claim 10, wherein said needle punched nonwoven fabric further comprises one or more thermoplastic fibers.

17. The barrier material of claim 10, wherein said needle punched nonwoven fabric further comprises one or more fibers selected from the group consisting of aramid fibers, basalt fibers, melamine fibers, carbon fibers, acrylic fibers, modacrylic fibers, polyphenylene sulfide fibers, fluorocarbon fibers, and polyimide fibers.

18. The barrier material of claim 10, wherein said barrier material maintains flame- and heat-resistant integrity when impinged with a gas flame in accordance with the testing protocol set forth in Technical Bulletin 603 of the State of California Department of Consumer Affairs (TB-603).

* * * * *